US009977371B2

(12) United States Patent
Kim et al.

(10) Patent No.: US 9,977,371 B2
(45) Date of Patent: May 22, 2018

(54) DRIVING DEVICE AND IMAGE FORMING APPARATUS INCLUDING THE SAME

(71) Applicant: S-Printing Solution Co., Ltd., Suwon-si (KR)

(72) Inventors: Sung-dae Kim, Suwon-si (KR); Bin-na Go, Suwon-si (KR); Dae-lim Shin, Suwon-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days. days.

(21) Appl. No.: 15/631,390

(22) Filed: Jun. 23, 2017

(65) Prior Publication Data

US 2018/0004126 A1 Jan. 4, 2018

(30) Foreign Application Priority Data

Jun. 30, 2016 (KR) ..... 10-2016-0082970

(51) Int. Cl.

| | |
|---|---|
| ***G03G 15/00*** | (2006.01) |
| ***G03G 15/08*** | (2006.01) |
| ***G03G 21/16*** | (2006.01) |
| ***G03G 21/18*** | (2006.01) |

(52) U.S. Cl.

CPC ..... *G03G 15/0896* (2013.01); *G03G 15/757* (2013.01); *G03G 21/1647* (2013.01); *G03G 21/186* (2013.01); *G03G 21/1825* (2013.01); *G03G 2221/1633* (2013.01); *G03G 2221/1657* (2013.01)

(58) Field of Classification Search

CPC ..... G03G 15/0896; G03G 15/77; G03G 21/1647; G03G 21/1825; G03G 21/186; G03G 2221/1633; G03G 2221/16575

See application file for complete search history.

(56) References Cited

U.S. PATENT DOCUMENTS

| | | | | |
|---|---|---|---|---|
| 8,655,230 | B2 * | 2/2014 | Kawamura | G03G 15/0121 399/228 |
| 8,768,214 | B2 | 7/2014 | Lee et al. | |
| 2016/0070199 | A1 * | 3/2016 | Oh | F16H 1/20 399/258 |

FOREIGN PATENT DOCUMENTS

| | | |
|---|---|---|
| KR | 10-2012-0065629 | 6/2012 |

* cited by examiner

*Primary Examiner* — Hoang Ngo
(74) *Attorney, Agent, or Firm* — Staas & Halsey LLP

(57) ABSTRACT

An electrophotographic image forming apparatus includes a driving device including a first gear and a second gear, a power transmitter configured to transfer a rotational force applied in one direction from the motor to the first and second gears; a cam configured to set the power transmitter to one of a release mode in which the motor is disconnected from the first and second gears, a first connection mode in which one of the first and second gears is connected to the motor, and a second connection mode in which the other of the first and second gears is connected to the motor; and a clutch configured to selectively transfer the rotational force applied in the one direction from the motor to the cam.

19 Claims, 21 Drawing Sheets

DRIVING DEVICE AND IMAGE FORMING APPARATUS INCLUDING THE SAME

CROSS-REFERENCE TO RELATED APPLICATIONS

This application claims the priority benefit of Korean Patent Application No. 10-2016-0082970, filed on Jun. 30, 2016, in the Korean Intellectual Property Office, the disclosure of which is incorporated herein in its entirety by reference.

BACKGROUND

1. Field

The following description relates to a driving device that transmits a rotational force applied in one direction from a driving source to two units, thereby driving the units, and an image forming apparatus including the driving device.

2. Description of the Related Art

An apparatus, for example, an image forming apparatus which is driven by the rotational force of a motor (i.e., a driving source), requires a driving device that selectively transmits the driving force of the motor to two or more bodies, thereby driving the bodies. To this end, a structure including a plurality of motors, a structure using forward rotation and backward rotation of one motor, etc. may be considered. Structures including a plurality of motors suffer from problems of increased cost. Structures using forward rotation and backward rotation of the motor suffer from problems related to the time required for changing rotational direction of the motor and a motor driving circuit, and such problems become worse as the inertia of a driven body increases.

SUMMARY

One or more example embodiments include a driving device that may selectively transmit a driving force of a motor to two driven bodies without changing a rotational direction of the motor.

Additional aspects will be set forth in part in the description which follows and, in part, will be apparent from the description, or may be learned by practice of the presented example embodiments.

According to one or more example embodiments, a driving device includes: a motor; a first gear and a second gear; a power transmitter configured to transfer a rotational force applied in one direction from the motor to the first and second gears; a cam configured to set the power transmitter to one of a release mode in which the motor is disconnected from the first and second gears, a first connection mode in which one of the first and second gears is connected to the motor, and a second connection mode in which the other of the first and second gears is connected to the motor; and a clutch configured to selectively transfer the rotational force applied in the one direction from the motor to the cam.

According to one or more example embodiments, an electrophotographic image forming apparatus includes: a main body including a photosensitive body on which an electrostatic latent image is formed and a developing roller configured to supply toner to the electrostatic latent image; and the driving device configured to drive the developing roller and the photosensitive body.

According to one or more example embodiments, an electrophotographic image forming apparatus includes: a main body; a developer cartridge attachable to the main body and including: a photosensitive drum, a developing roller configured to supply toner to an electrostatic latent image formed on the photosensitive drum, a first coupler connected to the developing roller, and a second coupler connected to the photosensitive drum; the driving device; a first output gear connected to any one of the first and second gears by an even number of gears, connected to the remaining one of the first and second gears by an odd number of gears, and connected to the first coupler; and a second output gear connected to the second coupler and connected to the motor without being coupled to the power transmitter.

BRIEF DESCRIPTION OF THE DRAWINGS

These and/or other aspects will become apparent and more readily appreciated from the following description of the example embodiments, taken in conjunction with the accompanying drawings in which.

DETAILED DESCRIPTION

The present disclosure will now be described more fully with reference to the accompanying drawings, in which example embodiments of the present disclosure are shown.

Expressions such as "at least one of", when preceding a list of elements, modify the entire list of elements and do not modify the individual elements of the list.

Figure 1:
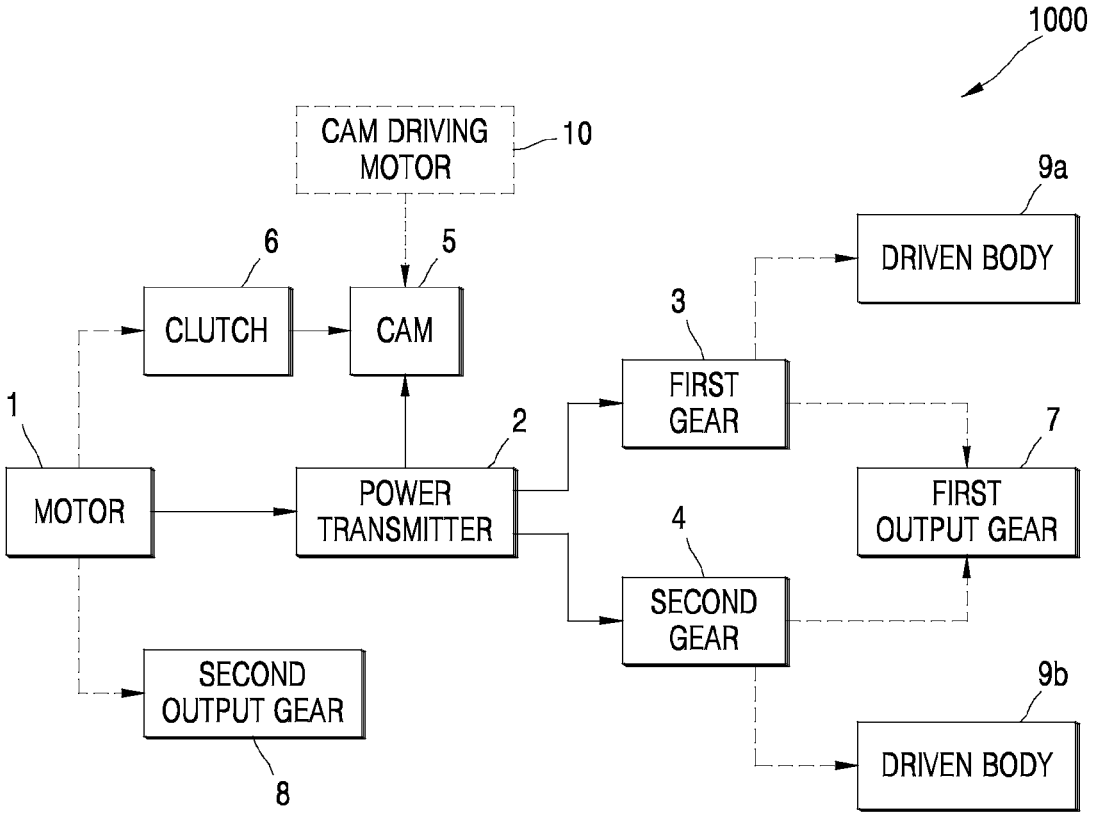
FIG. 1 is a block diagram illustrating a driving device according to an example embodiment.

FIG. 1 is a block diagram illustrating a driving device 1000 according to an example embodiment. Referring to FIG. 1, the driving device 1000 includes a motor 1 that rotates in a first direction, and a power transmitter 2 that selectively transmits a rotational force of the motor 1 to first and second gears 3 and 4. The power transmitter 2 is changed by a cam 5 to a release mode and a selective connection mode. The release mode corresponds to a state in which connection between the motor 1 and the first and second gears 3 and 4 is removed. The selective connection mode corresponds to a state in which the motor 1 is connected to the first gear 3 or the second gear 4. The selective connection mode may include a first selective connection mode in which the motor 1 is connected to the third gear 3 and a second selective connection mode in which the motor 1 is connected to the second gear 4.

The cam 5 may be driven by the motor 1. A clutch 6 is located between the cam 5 and the motor 1. The clutch 6 selectively transmits a rotational force of the motor 1 in the first direction to the cam 5. In this configuration, the motor 1 may be selectively connected to the first and second gears 3 and 4 without changing a rotational direction of the motor 1. Also, since the cam 5 is driven by the motor 1, the cam 5 has a large actuation force. Accordingly, even when a driving load of a driven body that is driven by the first and second gears 3 and 4 is large, a mode of the driving transmitter 2 may be easily changed.

As marked with a dashed line in FIG. 1, a cam driving motor 10 for driving the cam 5, instead of the clutch 6, may be further provided.

The first and second gears 3 and 4 themselves may be driven bodies, and may be respectively connected to driven bodies 9*a* and 9*b* to drive the driven bodies 9*a* and 9*b*. Accordingly, the driven bodies 9*a* and 9*b* may be selectively driven without changing a rotational direction of the motor 1.

Also, the first and second gears 3 and 4 may drive one driven body, for example, a first output gear 7. Referring to FIG. 1, the first and second gears 3 and 4 may be connected to the first output gear 7. The driving device 1000 may have a structure in which a rotational direction of the first output gear 7 varies according to which one from among the first and second gears 3 and 4 is connected to the motor 1. For example, one from among the first and second gears 3 and 4 may be connected by an even number of gears (not shown) to the first output gear 7, and the remaining one from among the first and second gears 3 and 4 may be connected by an odd number of gears (not shown) to the first output gear 7. In this case, the even number includes "0". In this configuration, the first output gear 7 may be rotated forwardly/backwardly without changing a rotational direction of the motor 1.

The driving device 1000 may further include a second output gear 8. The second output gear 8 is connected to the motor 1 without being coupled to the power transmitter 2. In this configuration, even while the motor is selectively connected to the first and second gears 3 and 4, the second output gear 8 may continuously rotate in the same direction. In a structure in which a rotational direction of the first output gear 7 varies according to which one from among the first and second gears 3 and 4 is connected to the motor 1, a rotational direction of the first output gear 7 may be changed without changing a rotational direction of the second output gear 8. Accordingly, since an inertial load of a driven body that is driven by the second output gear 8 is not changed while a rotational direction of the first output gear 7 is changed, a structure of a driving circuit for driving the motor 1 may be simplified.

Figure 2:
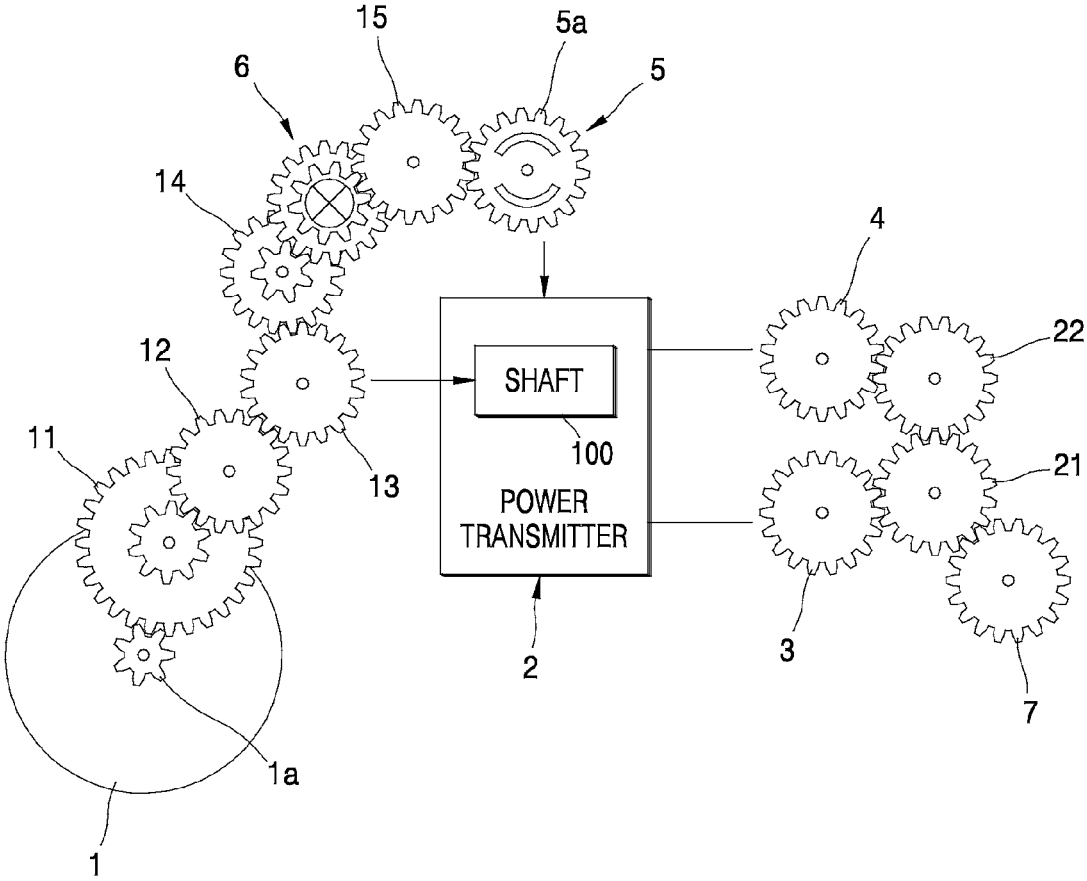
FIG. 2 is a view for explaining power connection of the driving device of FIG. 1 according to an example embodiment.

FIG. 2 is a view for explaining power connection of the driving device 1000 of FIG. 1 according to an example embodiment. Referring to FIG. 2, the power transmitter 2 includes a shaft 100. The shaft 100 is rotated by the motor 1. For example, a driving gear 1*a* provided on the motor 1 may be connected to the shaft 100 through gears 11, 12, and 13. For example, the gear 13 may be fixed to the shaft 100. The cam 5 includes a gear portion 5*a*. The gear portion 5*a* may be connected to the driving gear 1*a* provided on the motor 1 through the gears 11, 12, 13, and 14, the clutch 6, and a phase gear 15. The clutch 6 may clutch a rotational force transmitted from the motor 1 to the cam 5 due to an electrical signal. The clutch 6 may be implemented, for example, as a combination of a solenoid and a spring clutch, or a magnetic clutch. For example, when the clutch 6 is turned on, the motor 1 may be connected to the cam 5, and when the clutch 6 is turned off, connection between the motor 1 and the cam 5 may be removed.

The cam 5 and the first and second gears 3 and 4 may be rotatably provided on the shaft 100. Accordingly, the driving device 100 may be compact.

The first gear 3 may be connected to the first output gear 7 by a first connection gear 21. The second gear 4 and the first connection gear 21 may be connected to each other by a second connection gear 22. Accordingly, the first output gear 7 may be rotated forwardly/backwardly by selectively driving the first and second gears 3 and 4 by using the power transmitter 2. When any one from among the first and second gears 3 and 4 is connected to the motor 1, connection between the remaining one from among the first and second gears 3 and 4 and the motor 1 is removed. Accordingly, in a structure in which the first and the second gears 3 and 4 selectively drive the first output gear 7, it is possible that the first and second gears 3 and 4 are connected to each other by the first and second connection gears 21 and 22.

For example, the second output gear 8 may be any one from among the gears 11, 12, and 13. The second output gear 8 may be connected to any one from among the gears 11, 12, and 13. The second output gear 8 may be connected to the motor 1 by a power transmitting member (not shown).

Figure 3:
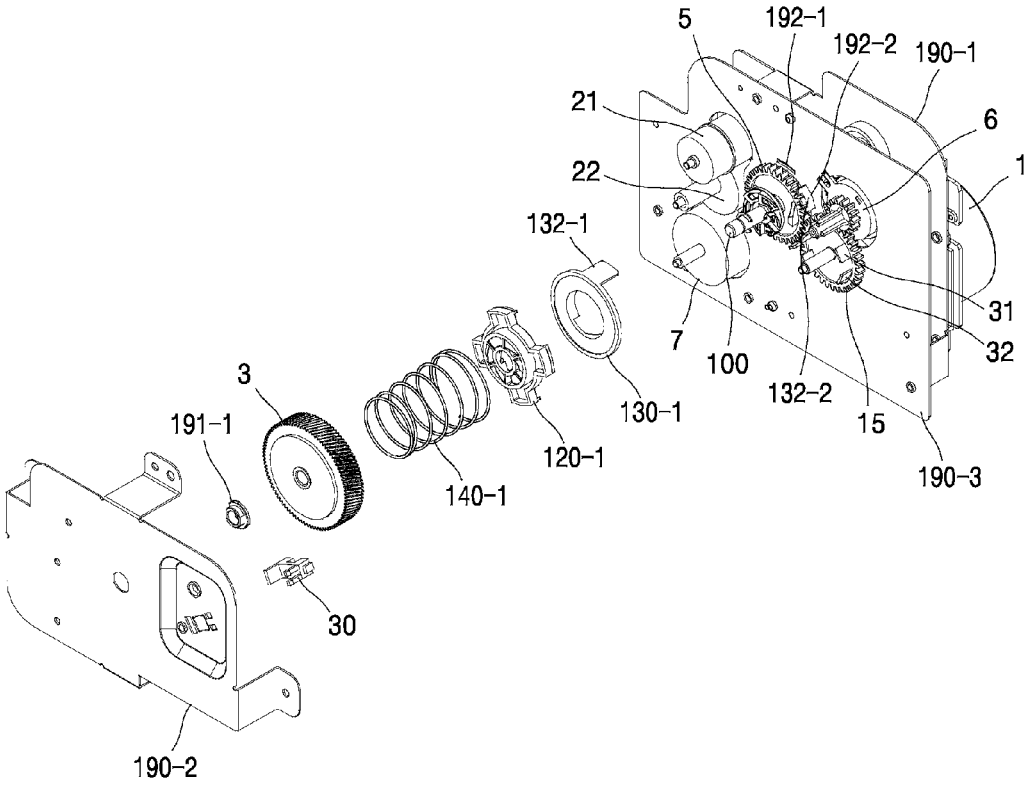
FIG. 3 is an exploded perspective view illustrating the driving device according to an example embodiment.
Figure 4:
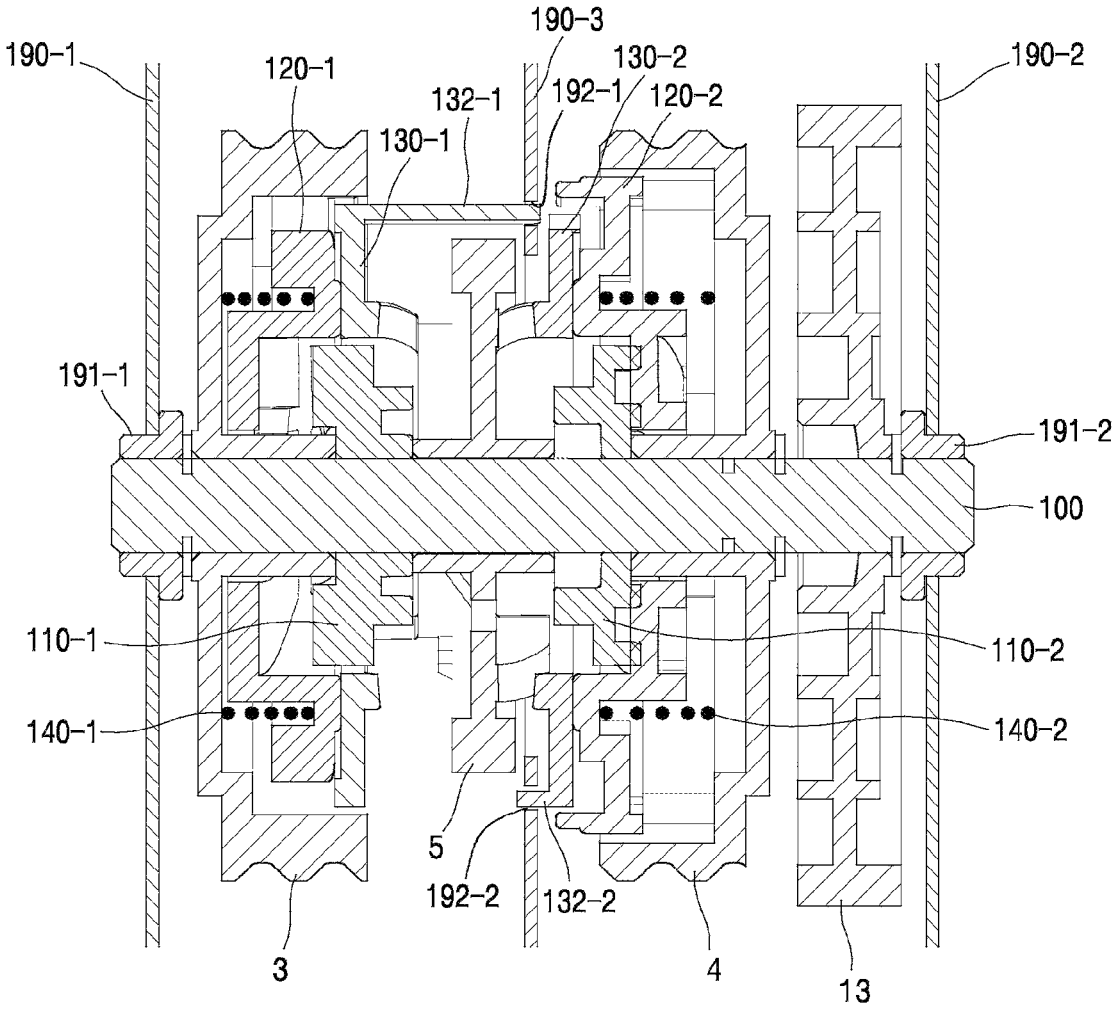
FIGS. 4 and 5 are respective cross-sectional and exploded perspective views illustrating a power transmitter according to an example embodiment.
Figure 5:
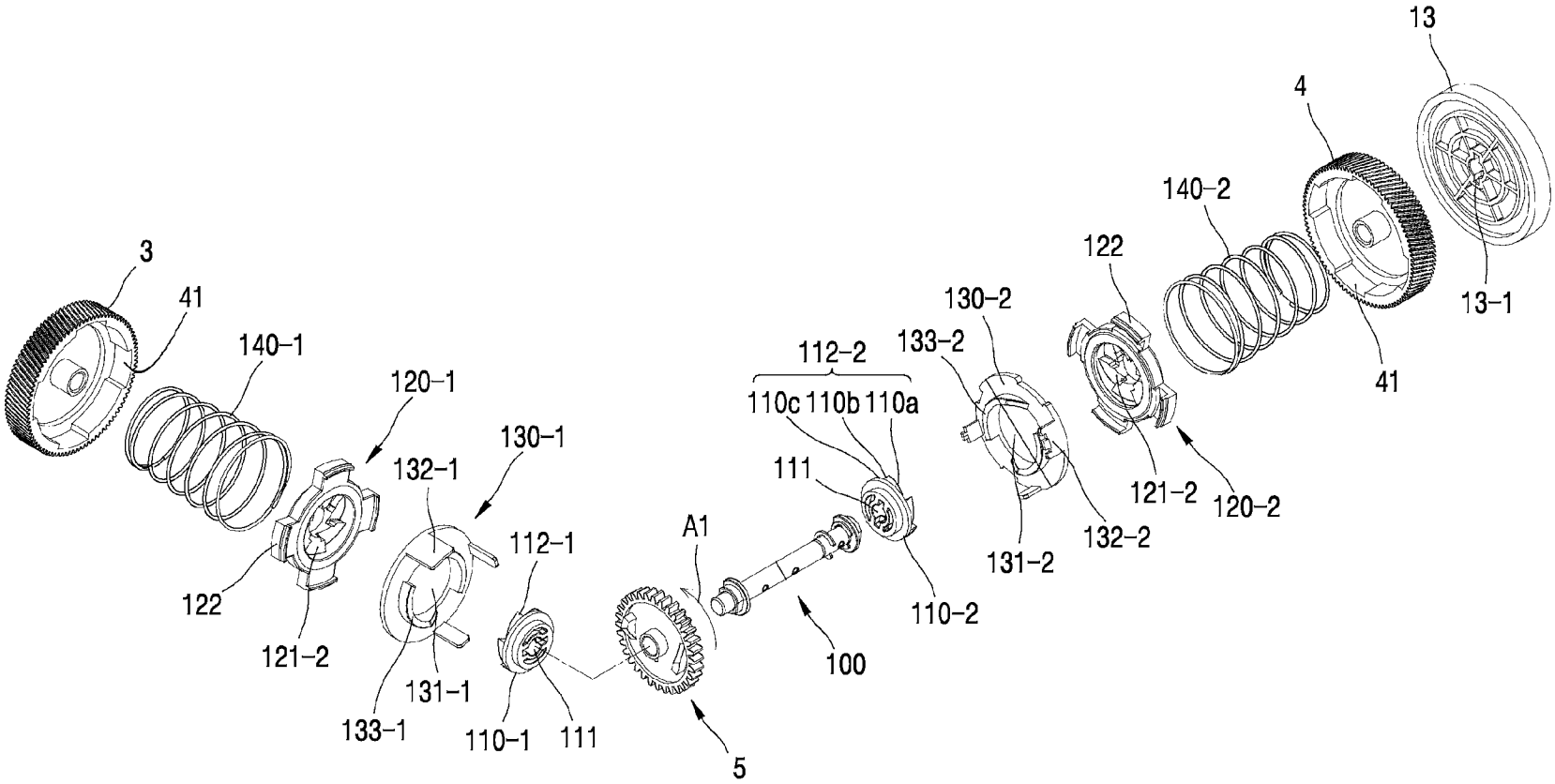
Figure 6:
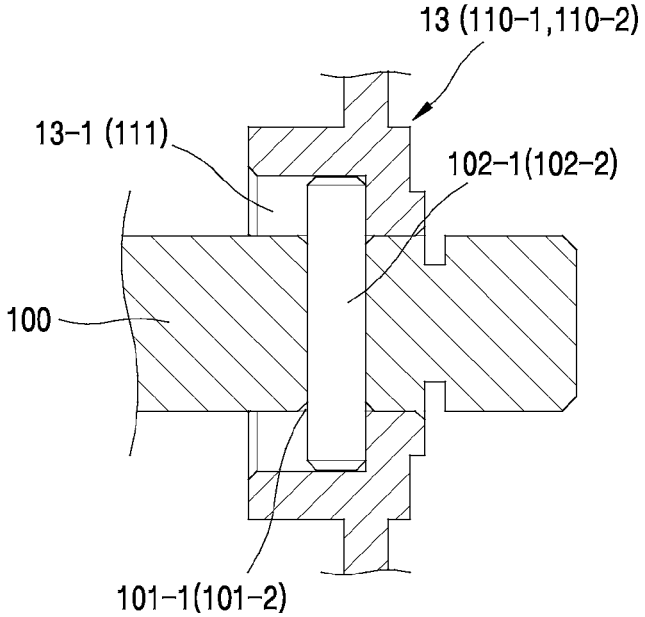
FIG. 6 is a cross-sectional view illustrating a structure to fix a member to a shaft according to an example embodiment.

FIG. 3 is a partial exploded perspective view illustrating the driving device 1000 according to an example embodiment. FIGS. 4 and 5 are respective cross-sectional and exploded perspective views illustrating the power transmitter 2 according to an example embodiment. Referring to FIGS. 3 through 5, the shaft 100 may be supported by two brackets, e.g., first and second brackets 190-1 and 190-2, with bearing members 191-1 and 191-2 therebetween. The gear 13 is fixed to the shaft 100. The gear 13 being 'fixed' to the shaft 100 refers to the gear 13 rotating along with the shaft 100. For example, as shown in FIG. 6, a pin 102-1 may be inserted into a pin hole 101-1 formed in the shaft 100, and a pin receiving portion 13-1 in which the pin 102-1 is received may be formed in the gear 13. Accordingly, a rotational force of the gear 13 may be transmitted to the shaft 100 through the pin receiving portion 13-1, the pin 102-1, and the pin hole 101-1.

First and second fixed latch members 110-1 and 110-2 are provided on the shaft 100 to be spaced apart from each other in an axial direction. The first and second fixed latch members 110-1 and 110-2 are fixed to the shaft 100. For example, as shown in FIG. 6, a pin 102-2 may be inserted into a pin hole 101-2 formed in the shaft 100, and a pin receiving portion 111 in which the pin 102-2 is received may be formed in the first and second fixed latch members 110-1 and 110-2. First and second fixed latch portions 112-1 and 112-2 are respectively provided on the first and second fixed latch members 110-1 and 110-2. Each of the first and second fixed latch portions 112-1 and 112-2 may have a shape for transmitting a rotational force in one direction, for example, a direction A1, to another member. For example, each of the first and second fixed latch portions 112-1 and 112-2 may include an inclined surface 110*a* that gradually protrudes from one surface 110*c* of each of the first and second fixed latch members 110-1 and 110-2 in the axial direction and a facing surface 110*b* that extends from a top end portion of the inclined surface 110*a* to the surface 110*c*. The facing surface 110*b* may be parallel to the axial direction. Alternatively, the facing surface 110*b* may be inclined with respect to the axial direction.

First and second movable latch members 120-1 and 120-2 are located outside the first and second fixed latch members 110-1 and 110-2. The first and second movable members 120-1 and 120-2 are provided to rotate about the shaft 100 and move in the axial direction. First and second movable latch portions 121-1 and 121-2 respectively corresponding to the first and second fixed latch portions 112-1 and 112-2 are provided on the first and second fixed latch members 110-1 and 110-2. The first and second movable latch portions 121-1 and 121-2 have shapes that are complimentary to those of the first and second fixed latch portions 112-1 and 112-2. When the first and second movable latch portions 121-1 and 121-2 are engaged with the first and second fixed latch portions 112-1 and 112-2, the first and second movable latch members 120-1 and 120-2 rotate in the direction A1 along with the first and second fixed latch members 110-1 and 110-2.

In an example embodiment, the first and second gears 3 and 4 may be rotatably provided on the shaft 100. The first and second movable latch members 120-1 and 120-2 are connected to the first and second gears 3 and 4 in the axial direction. For example, an extending portion 122 that extends in a radial direction is provided on each of the first and second movable latch members 120-1 and 120-2, and a receiving portion 41 in which the extending portion 122 is received is formed in each of the first and second gears 3 and 4. While the first and second movable latch members 120-1 and 120-2 move in the axial direction due to the cam 5, a state in which the extending portion 122 is received in the receiving portion 41 is maintained. Accordingly, when the first and second movable latch members 120-1 and 120-2 rotate in the direction A1, the first and second gears 3 and 4 rotate along with the first and second movable latch members 120-1 and 120-2.

First and second elastic members 140-1 and 140-2 apply an elastic force to the first and second movable latch members 120-1 and 120-2 to move in a direction where the first and second movable latch portions 121-1 and 121-2 are engaged with the first and second fixed latch portions 112-1 and 112-2. For example, the first and second elastic members 140-1 and 140-2 may be compression coil springs respectively located between the first gear 3 and the first movable latch member 120-1 and between the second gear 4 and the second movable latch member 120-2.

Figure 7A:
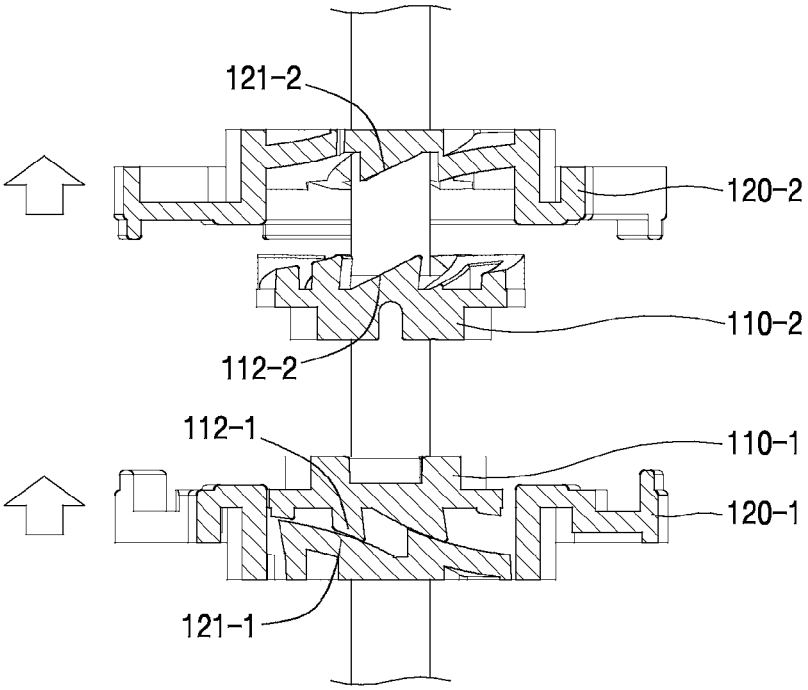
FIGS. 7A, 7B, and 7C are cross-sectional views respectively illustrating a first selective connection mode, a release mode, and a second selective connection mode of the power transmitter.
Figure 7B:
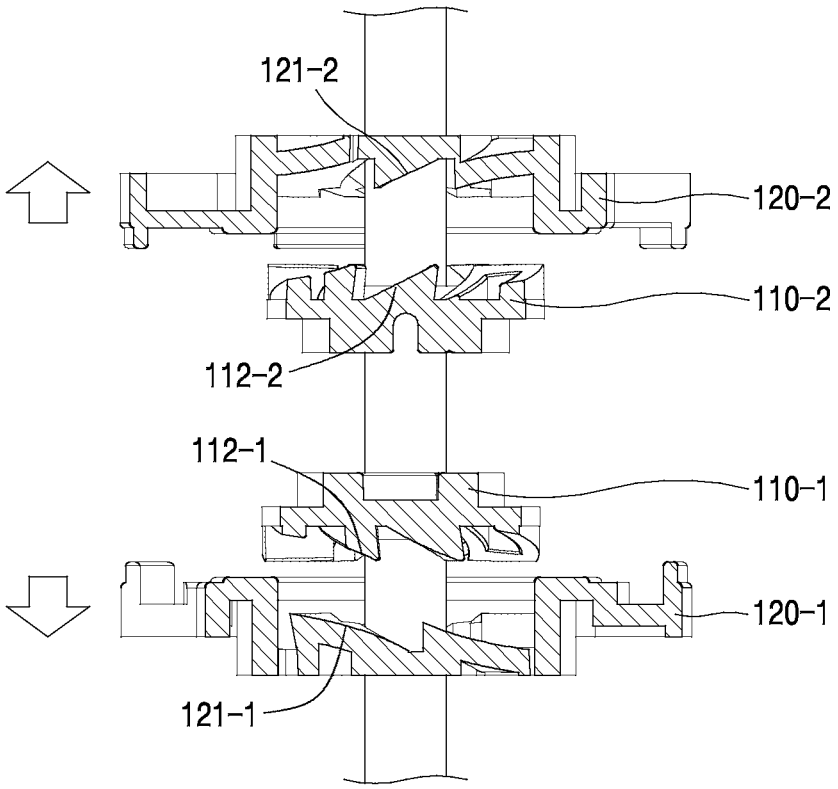
Figure 7C:
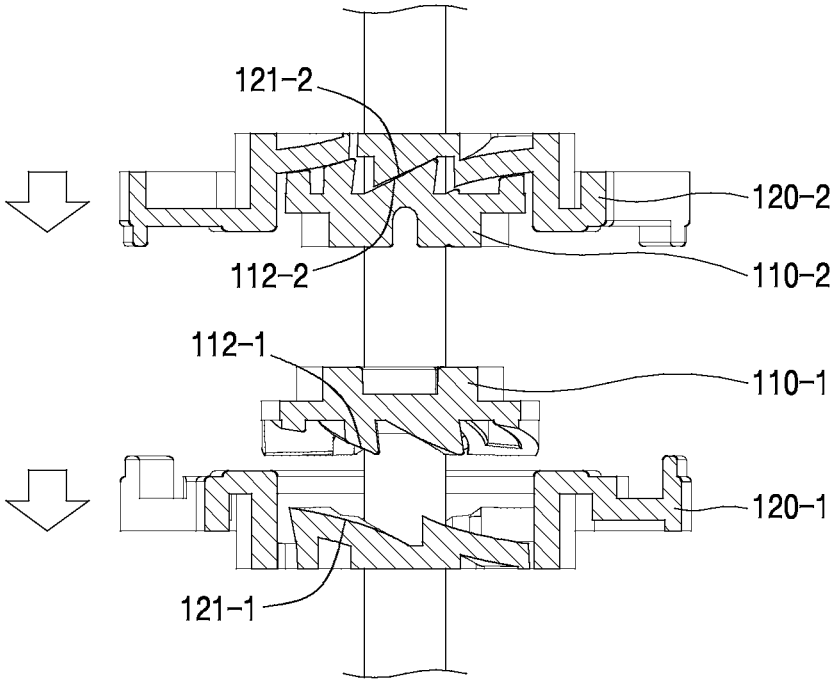

The first and second movable latch portions 121-1 and 121-2 may be selectively engaged with the first and second fixed latch portions 112-1 and 112-2 by selectively moving the first and second movable latch members 120-1 and 120-2 in the axial direction. FIGS. 7A, 7B, and 7C respectively illustrate a first selective connection mode, a release mode, and a second selective connection mode of the power transmitter 2.

As shown in FIG. 7A, only the first gear 3 may be driven by moving the first movable latch member 120-1 to the first fixed latch member 110-1 so that the first movable latch portion 121-1 and the first fixed latch portion 112-1 are engaged with each other and moving the second movable latch member 120-2 away from the second fixed latch member 110-2 so that the second movable latch portion 121-2 and the second fixed latch portion 112-2 are separated from each other.

Also, as shown in FIG. 7B, a rotational force may be prevented from being transmitted to the first and second gears 3 and 4 by moving the first and second movable latch members 120-1 and 120-2 away from the first and second fixed latch members 110-1 and 110-2 so that the first and second movable latch portions 121-1 and 121-2 are separated from the first and second fixed latch portions 112-1 and 112-2.

As shown in FIG. 7C, only the second gear 4 may be driven by moving the first movable latch member 120-1 away from the first fixed latch member 110-1 so that the first movable latch portion 121-1 and the first fixed latch portion 112-1 are separated from each other and moving the second movable latch member 120-2 to the second fixed latch member 110-2 so that the second movable latch portion 121-2 and the second fixed latch portion 112-2 are engaged with each other.

A mode of the power transmitter 2 may be changed by the cam 5. Referring to FIGS. 3 through 5, the cam 5 is rotatably provided on the shaft 100. The cam 5 is located between the first and second fixed latch members 110-1 and 110-2. The cam 5 may change a mode of the power transmitter 2 to a release mode and first and second selective connection modes by moving the first and second movable latch members 120-1 and 120-2. In the present example embodiment, first and second push members 130-1 and 130-2 are respectively located between the cam 5 and the first movable latch member 120-1 and between the cam 5 and the second movable latch member 120-2. The first and second push members 130-1 and 130-2 are provided to move in the axial direction. A state in which the first and second push members 130-1 and 130-2 contact the first and second movable latch members 120-1 and 120-2 is maintained due to an elastic force of the first and second elastic members 140-1 and 140-2. The first and second push members 130-1 and 130-2 move in the axial direction according to a rotational phase of the cam 5 to selectively allow engagement between the first and second movable latch members 121-1 and 121-2 and the first and second fixed latch portions 112-1 and 112-2.

The first and second movable latch portions 121-1 and 121-2 and the first and second fixed latch portions 112-1 and 112-2 are engaged with each other in through-holes 131-1 and 131-2 formed in the first and second push members 130-1 and 130-2. The first and second push members 130-1 and 130-2 move in the axial direction and do not rotate. For example, anti-rotation arms 132-1 and 132-2 that extend in the axial direction are provided on the first and second push members 130-1 and 130-2. The anti-rotation arms 132-1 and 132-2 may be inserted into, for example, anti-rotation grooves 192-1 and 192-2 formed in a third bracket 190-3. The first and second brackets 190-1 and 190-2 may be coupled to the third bracket 190-3.

Figure 8:
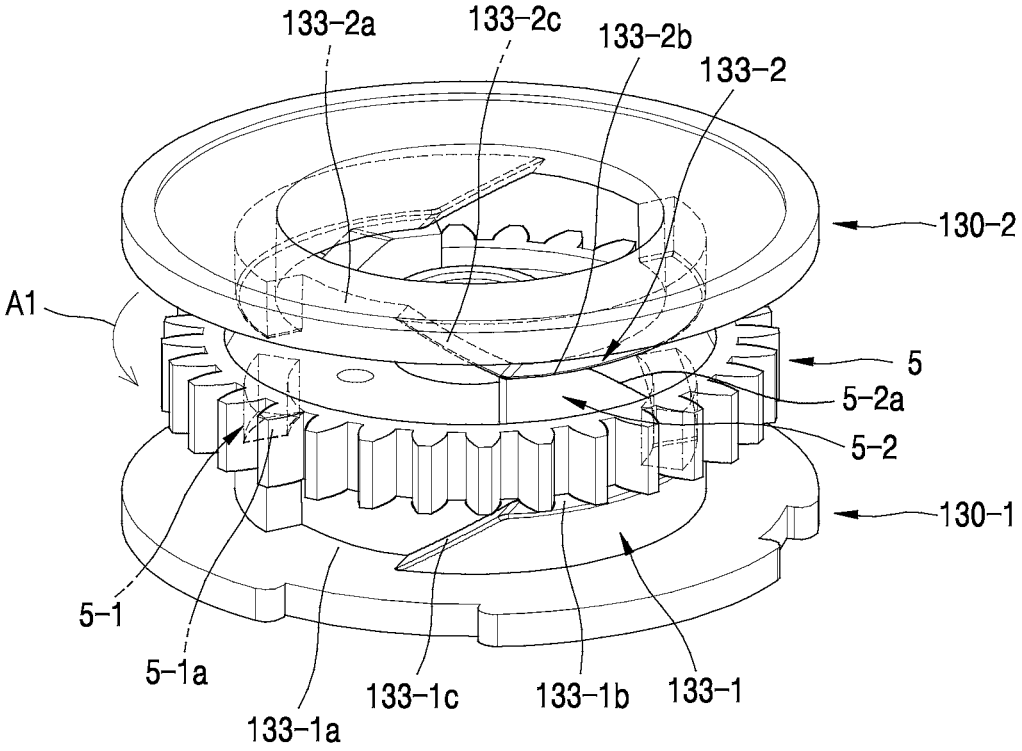
FIG. 8 is a detailed view illustrating a cam and first and second push members according to an example embodiment.

FIG. 8 is a detailed view illustrating the cam 5 and the first and second push members 130-1 and 130-2. Referring to FIG. 8, first and second push cam portions 133-1 and 133-2 are respectively provided on the first and second push members 130-1 and 130-2, and first and second cam portions 5-1 and 5-2 that respectively contact the first and second push cam portions 133-1 and 133-2 are provided on the cam 5. In FIG. 8, shapes of the first and second push members 130-1 and 130-2 are simply shown in order to clarify a connection relationship between the cam 5 and the first and second push members 130-1 and 130-2.

One of the first and second push cam portions 133-1 and 133-2 and the first and second cam portions 5-1 and 5-2 may have first and second cam profiles. In the present example embodiment, the first and second push cam portions 133-1 and 133-2 have first and second cam profiles.

The first and second push cam portions 133-1 and 133-2 include concave portions 133-1*a* and 133-2*a* and protruding portions 133-1*b* and 133-2*b* protruding from the concave portions 133-1*a* and 133-2*a* toward the first and second cam portions 5-1 and 5-2. The concave portions 133-1*a* and 133-2*a* and the protruding portions 133-1*b* and 133-2*b* may be connected to each other by inclined portions 133-1*c* and 133-2*c*. The amount of protrusion of the inclined portions 133-1*c* and 133-2*c* increases in a rotational direction of the cam 5, that is, the direction A1, from the concave portions 133-1*a* and 133-2*a* to the protruding portions 133-1*b* and 133-2*b*.

The first and second cam portions 5-1 and 5-2 respectively protrude to the first and second push cam portions 133-1 and 133-2. Inclined portions 5-1*a* and 5-2*a* may be provided on the first and second cam portions 5-1 and 5-2 so that when the cam 5 rotates in the direction A1, the first and second cam portions 5-1 and 5-2 naturally face the protruding portions 133-1*b* and 133-2*b* along the inclined portions 133-1*c* and 133-2*c*.

The concave portions 133-1*a* and 133-2*a* are first and second connection sections that cause the first fixed latch portion 112-1 to be engaged with the first movable latch portion 131-1 and the second fixed latch portion 112-2 to be engaged with the second movable latch portion 131-2, and the protruding portions 133-1*b* and 133-2*b* are first and second separation sections that cause the first fixed latch portion 112-1 to be separated from the first movable latch portion 131-1 and the second fixed latch portion 112-2 to be separated from the second movable latch portion 131-2. The first and second cam profiles may be formed by the first and second connection sections and the first and second separation sections.

A phase difference of the first and second cam portions 5-1 and 5-2 and shapes and a phase difference of the first and second cam profiles are determined so that the first and second selective connection modes and the release mode are implemented.

Figure 9A:
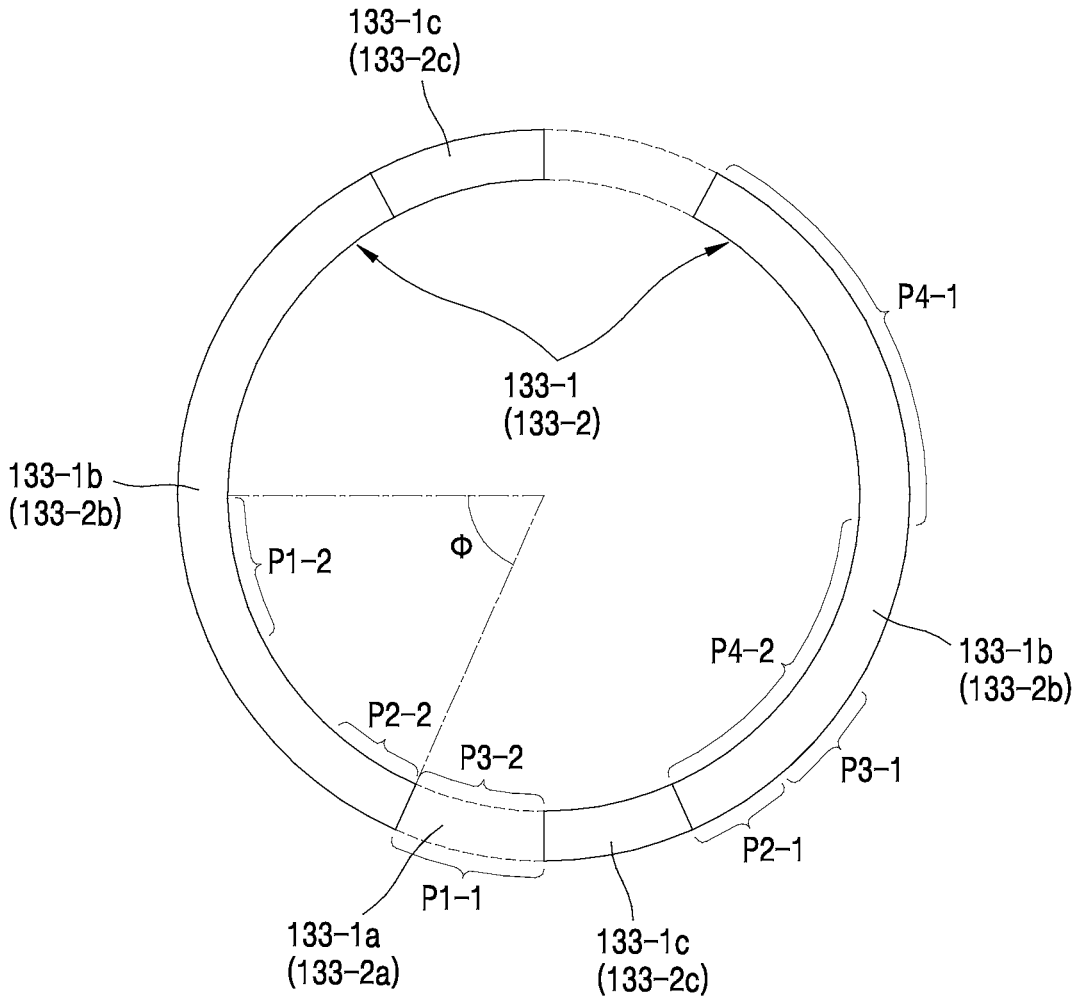
FIGS. 9A and 9B are respectively a plan view and a development drawing illustrating cam profiles of first and second push cam portions according to an example embodiment in which two release modes are implemented.
Figure 9B:
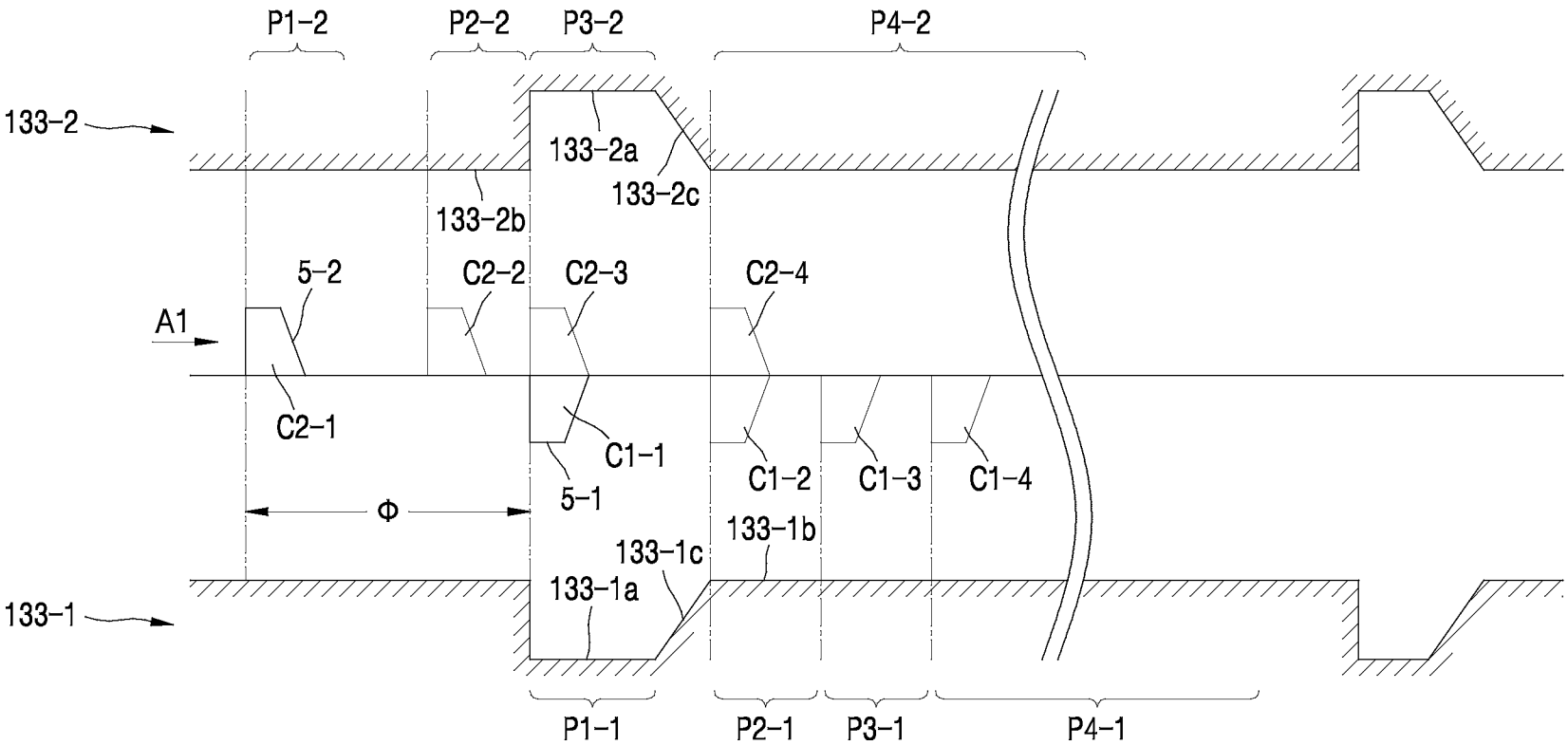
Figure 9C:
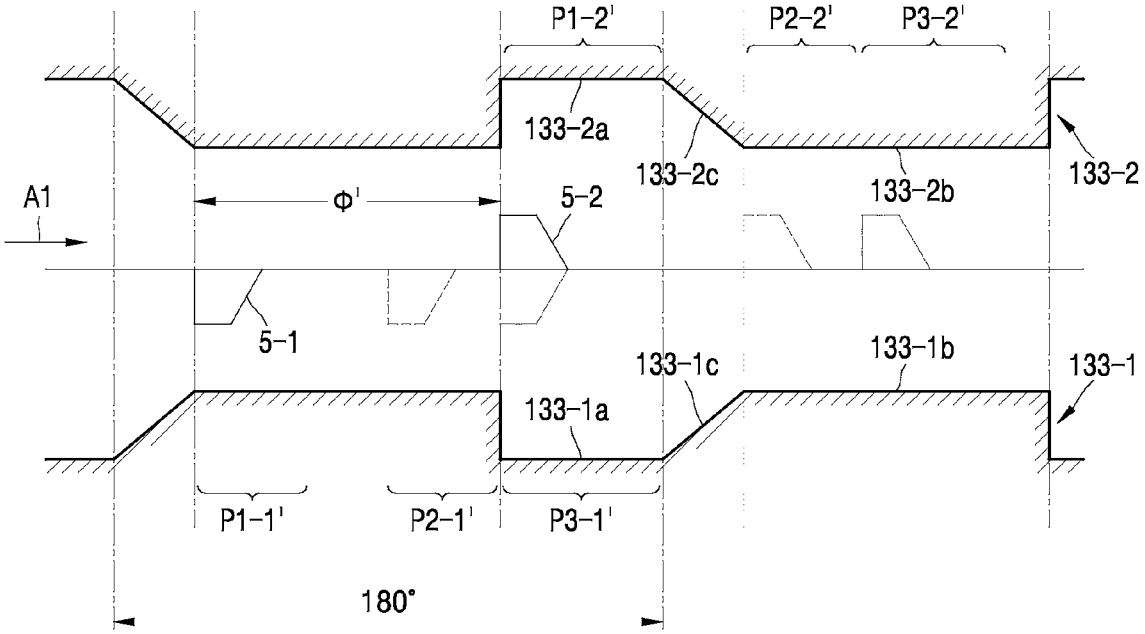
FIG. 9C is a development drawing illustrating cam profiles of first and second push cam portions, according to an example embodiment in which a release mode is implemented between first and second connection modes.
Figure 10A:
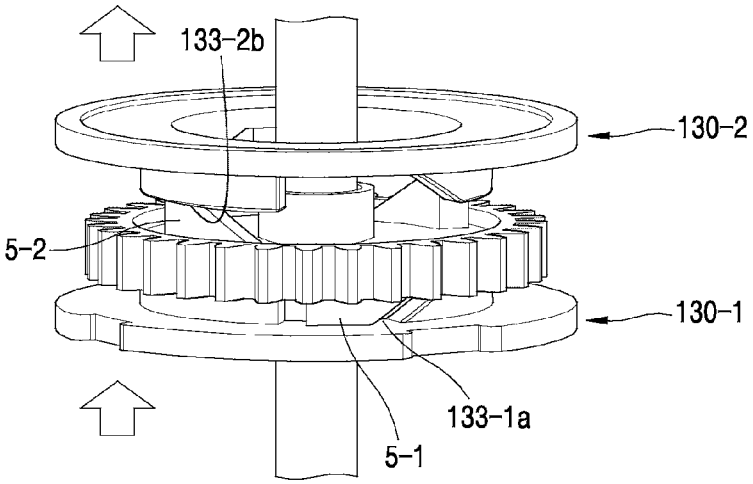
FIGS. 10A, 10B, and 10C are views for explaining a first selective connection mode, a release mode, and a second selective connection mode according to the cam profiles of FIGS. 9B and 9C.
Figure 10B:
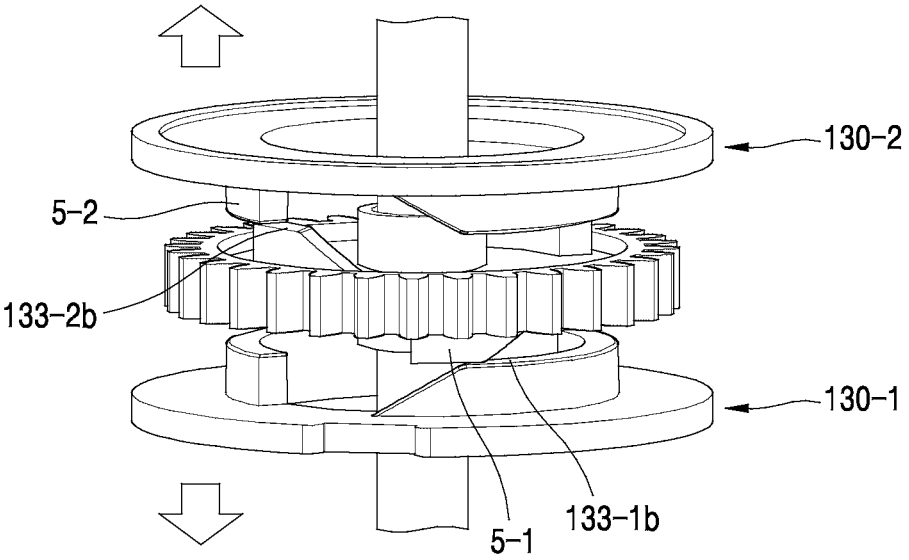
Figure 10C:
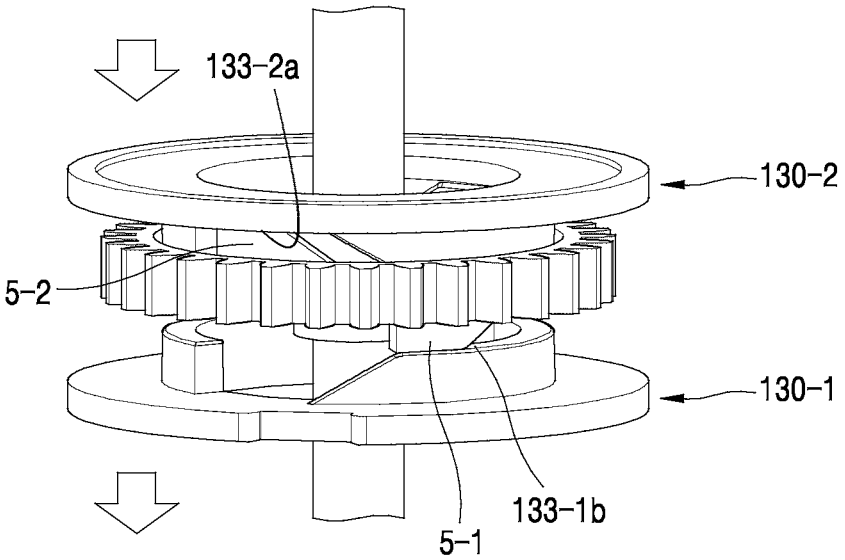

FIGS. 9A and 9B are respectively a plan view and a development drawing illustrating cam profiles of the first and second cam portions 5-1 and 5-2 and the first and second push cam portions 133-1 and 133-2 according to an example embodiment. In the embodiment of FIGS. 9A and 9B, two release modes are implemented. FIG. 9C is a development drawing illustrating cam profiles of the first and second cam portions 5-1 and 5-2 and the first and second push cam portions 133-1 and 133-2 according to an example embodiment. In the embodiment of FIG. 9C, a release mode is implemented between the first and second selective connection modes. FIGS. 10A, 10B, and 10C are views for explaining operations according to the cam profiles of FIGS. 9A, 9B, and 9C, respectively illustrating a first selective connection mode, a release mode, and a second selective connection mode. In the present example embodiment, the first cam portion 5-1 and the second cam portion 5-2 have a phase difference Φ and the first and second cam profiles have no phase difference.

As denoted by reference numbers C1-1 and C2-1 in FIG. 9B, due to the phase difference Φ, the first cam portion 5-1 is located in a section P1-1 of the first push cam portion 133-1 and the second cam portion 5-2 is located in a section P1-2 of the second push cam portion 133-2. As shown in FIG. 10A, the first cam portion 5-1 contacts the concave portion 133-1*a*, and the first push member 130-1 and the first movable latch member 120-1 are pushed to the first fixed latch member 110-1 due to an elastic force of the first elastic member 140-1. In this case, the second cam portion 5-2 contacts the protruding portion 133-2*b*. Accordingly, the second push member 130-2 and the second movable latch member 120-2 are pushed in a direction opposite to a direction of an elastic force of the second elastic member 140-2. As shown in FIG. 7A, the first movable latch portion 121-1 is engaged with the first fixed latch portion 112-1, and the second movable latch portion 121-2 is separated from the second fixed latch portion 112-2. Accordingly, a mode of the power transmitter 2 becomes a first selective connection mode in which only the first gear 3 may be rotated by the motor 1.

The cam 5 rotates in the direction A1, and as denoted by reference numbers C1-2 and C2-2 in FIG. 9B, the first and second cam portions 5-1 and 5-2 are respectively located in sections P2-1 and P2-2 of the first and second push cam portions 133-1 and 133-2. As shown in FIG. 10B, the first cam portion 5-1 passes through the inclined portion 133-1*c* from the concave portion 133-1*a* and contacts the protruding portion 133-1*b*. The first push member 130-1 and the first movable latch member 120-1 move in a direction opposite to a direction of an elastic force of the first elastic member 140-1. A state in which the second cam portion 5-2 contacts the protruding portion 133-2*b* is maintained, and a state in which the second movable latch portion 121-2 is separated from the second fixed latch portion 112-2 is maintained. Accordingly, as shown in FIG. 7B, the first movable latch portion 121-1 is separated from the first fixed latch portion 112-1, and the second movable latch portion 121-2 is separated from the first fixed latch portion 112-2. A mode of the power transmitter 2 becomes a release mode (first release mode) in which a rotational force of the motor 1 is not transmitted to the first and second gears 3 and 4.

The cam 5 continuously rotates in the direction A1, and as marked by reference numbers C1-3 and C2-3 in FIG. 9B, the first and second cam portions 5-1 and 5-2 are respectively located in sections P3-1 and P3-2 of the first and second push cam portions 133-1 and 133-2. As shown in FIG. 10C, a state in which the first cam portion 5-1 contacts the protruding portion 133-1*b* is maintained, and a state in which the first movable latch portion 121-1 is separated from the first fixed latch portion 112-1 is maintained. The second cam portion 5-2 escapes from the protruding portion 133-2*b* and contacts the concave portion 133-2*a*. The second push member 130-2 and the second movable latch member 120-2 are pushed to the second fixed latch member 110-2 due to an elastic force of the second elastic member 140-2. Accordingly, as shown in FIG. 7C, the first movable latch portion 121-1 and the first fixed latch portion 112-1 are separated from each other, and the second movable latch portion 121-2 and the second fixed latch portion 112-2 are engaged with each other. A mode of the power transmitter 2 becomes a second selective connection mode in which only the second gear 4 may be rotated by the motor 1.

The cam 5 continuously rotates in the direction A1, and as marked by reference numbers C1-4 and C2-4 in FIG. 9B, the first and second cam portions 5-1 and 5-2 are respectively located in sections P4-1 and P4-2 of the first and second push cam portions 133-1 and 133-2. A state in which the first cam portion 5-1 contacts the protruding portion 133-1*b* is maintained, and the second cam portion 5-2 passes through the inclined portion 133-2*c* and contacts the protruding portion 133-2*b*. The second push member 130-2 and the second movable latch member 120-2 move in a direction opposite to a direction of an elastic force of the second elastic member 140-2. Accordingly, the first movable latch portion 121-1 is separated from the first fixed latch portion 112-1, and the second movable latch portion 121-2 is separated from the second fixed latch portion 112-2. A mode of the power transmitter 2 becomes again a release mode (second release mode) in which a rotational force of the motor 1 is not transmitted to the first and second gears 3 and 4.

As such, shapes of the first and second push cam portions 133-1 and 133-2 and the phase difference Φ between the first and second cam portions 5-1 and 5-2 are determined so that the first and second fixed latch portions 112-1 and 112-2 and the first and second movable latch portions 121-1 and 121-2 are simultaneously separated from each other. According to an example embodiment of FIGS. 9A and 9B, the phase difference Φ is determined so that the first and second cam portions 5-1 and 5-2 simultaneously contact the protruding portions 133-1*b* and 133-2*b* in the sections P2-1 and P2-2 and the sections P4-1 and P4-2. Accordingly, the power transmitter 2 may be sequentially changed to the first selective connection mode, the first release mode, the second selective connection mode, and the second release mode by rotating the cam 5 in the direction A1. In a structure in which the first output gear 7 is connected to the first gear 3 and the second gear 4 and rotates forwardly and backwardly as shown in FIG. 2, when a mode is directly changed from the first selective connection mode to the second selective connection mode, a forward driving force and a backward driving force are simultaneously applied to the first output gear 7 at a time when the mode is changed, and thus the first output gear 7 may be locked without rotating. This occurs even when a mode is directly changed from the second selective connection mode to the first selective connection mode. The locking may be avoided by locating the release mode between the first selective connection mode and the second selective connection mode and between the second selective connection mode and the first selective connection mode. The present example embodiment may be applied to a structure in which the first and second gears 3 and 4 respectively drive the driven bodies 9*a* and 9*b* as shown in FIG. 1, also.

Although the power transmitter 2 has two release modes, the scope of the present disclosure is not limited thereto.

For example, as shown in FIG. 9C, cam profiles and a phase difference of the first and second cam portions 5-1 and 5-2 and the first and second push cam portions 133-1 and 133-2 may be determined so that the power transmitter 2 is sequentially changed to the second selective connection mode, the release mode, and the first selective connection mode. The example embodiment may be applied to a structure in which the first and second gears 3 and 4 respectively drive the driven bodies 9*a* and 9*b* as shown in FIG. 1.

As marked with a solid line in FIG. 9C, the first and second cam portions 5-1 and 5-2 are respectively located in sections P1-1' and P1-2' of the first and second push cam portions 133-1 and 133-2 due to a phase difference Φ'. As shown in FIG. 10C, the first cam portion 5-1 contacts the protruding portion 133-1*b*, and the first push member 130-1 and the first movable latch member 120-1 move in a direction opposite to a direction of an elastic force of the first elastic member 140-1. In this case, the second cam portion 5-2 contacts the concave portion 133-2*a*. Accordingly, the second push member 130-2 and the second movable latch member 120-2 are pushed to the second fixed latch member 110-2 due to an elastic force of the second elastic member 140-2. As shown in FIG. 7C, the first movable latch portion 121-1 is separated from the first fixed latch portion 112-1, and the second movable latch portion 121-2 and the second fixed latch portion 112-2 are engaged with each other. Accordingly, a mode of the power transmitter 2 becomes the second selective connection mode in which only the second gear 4 may be rotated by the motor 1.

As marked with a dashed line in FIG. 9C, the cam 5 rotates in the direction A1, and the first and second cam portions 5-1 and 5-2 are respectively located in sections P2-1' and P2-2' of the first and second push cam portions 133-1 and 133-2. As shown in FIG. 10B, a state in which the first cam portion 5-1 contacts the protruding portion 133-1*b* is maintained. The second cam portion 5-2 passes through the inclined portion 133-2*c* from the concave portion 133-2*a* and contacts the protruding portion 133-2*b*. Accordingly, the second push member 130-2 and the second movable latch member 120-2 move in a direction opposite to a direction of an elastic force of the second elastic member 140-2. As shown in FIG. 7B, the first movable latch portion 121-1 is separated from the first fixed latch portion 112-1, and the second movable latch portion 121-2 is separated from the first fixed latch portion 112-2. Accordingly, a mode of the power transmitter 2 becomes the release mode in which a rotational force of the motor 1 is not transmitted to the first and second gears 3 and 4.

As marked with a dash-dotted line in FIG. 9C, the cam 5 continuously rotates in the direction A1, and the first and second cam portions 5-1 and 5-2 are respectively located in sections P3-1' and P3-2' of the first and second push cam portions 133-1 and 133-2. As shown in FIG. 10A, the first cam portion 5-1 contacts the concave portion 133-1*a*. The first push member 130-1 and the first movable latch member 120-1 are pushed to the first fixed latch member 110-1 due to an elastic force of the first elastic member 140-1. A state in which the second cam portion 5-2 contacts the protruding portion 133-2*b* is maintained. Accordingly, as shown in FIG. 7A, the first movable latch portion 121-1 and the first fixed latch portion 112-1 are engaged with each other, and the second movable latch portion 121-2 is separated from the second fixed latch nit 112-2. Accordingly, a mode of the power transmitter 2 becomes the first selective connection mode in which only the first gear 3 may be rotated by the motor 1.

Although phases of the first and second push cam portions 133-1 and 133-2 are the same and the first and second cam portions 5-1 and 5-2 have the phase difference Φ or Φ' in the above example embodiments, a combination of the first and second push cam portions 133-1 and 133-2 and the first and second cam portions 5-1 and 5-2 is not limited thereto.

Figure 11A:
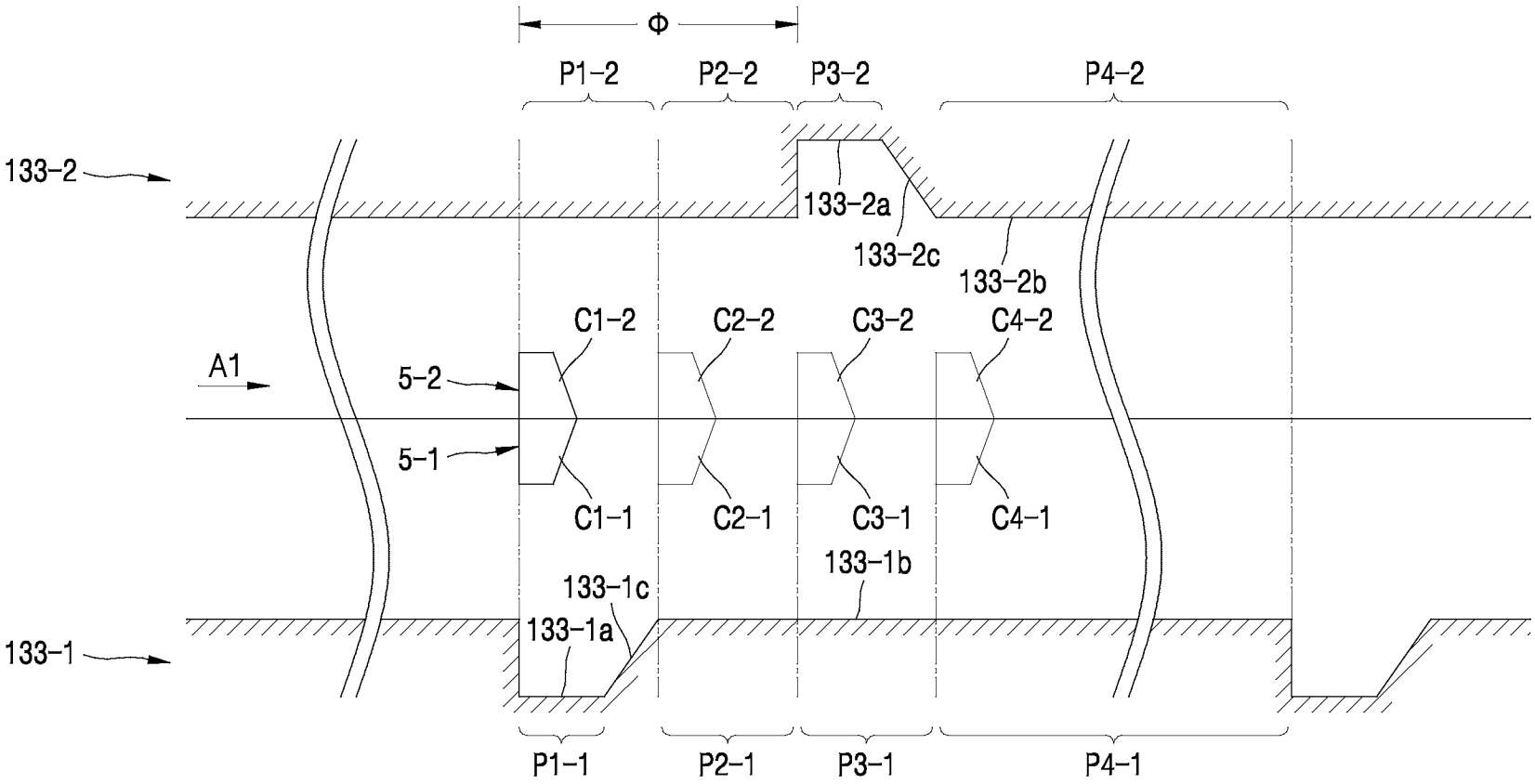
FIG. 11A is a development drawing illustrating cam profiles of first and second push cam portions according to an example embodiment, which are a modification of the cam profiles of FIGS. 9A and 9B.

FIG. 11A is a development drawing illustrating cam profiles 5-1 and 5-2 of first and second push cam portions 133-1 and 133-2 according to an example embodiment. The cam profiles of FIG. 11A are a modification of the cam profiles of FIG. 9B. In FIG. 11A, the first and second push cam portions 133-1 and 133-2 have the phase difference Φ and phases of the first and second cam portions 5-1 and 5-2 are the same.

Figure 11B:
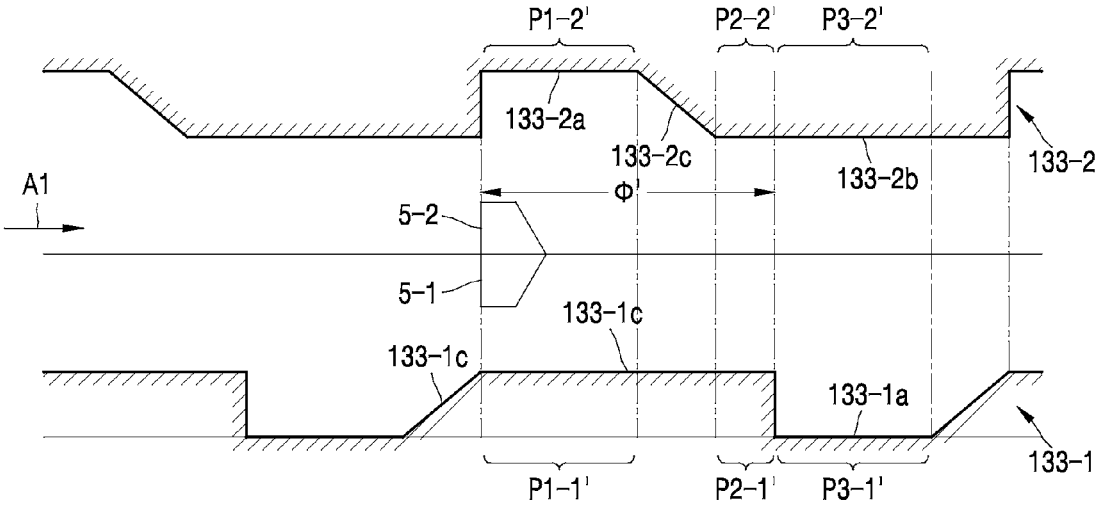
FIG. 11B is a development drawing illustrating cam profiles of first and second push cam portions according to an example embodiment, which are a modification of the cam profiles of FIG. 9C.

FIG. 11B is a development drawing illustrating cam profiles 5-1 and 5-2 of first and second push cam portions 133-1 and 133-2 according to an example embodiment. The cam profiles of FIG. 11B are a modification of FIG. 9C. In FIG. 11B, the first and second push cam portions 133-1 and 133-2 have the phase difference Φ' and phases of the first and second cam portions 5-1 and 5-2 are the same.

Although shapes of the first and second push cam portions 133-1 and 133-2 are the same in FIGS. 9B and 9C and FIGS. 11A and 11B, as long as the release mode and the first and second selective connection modes may be implemented, shapes of the first and second push cam portions 133-1 and 133-2 do not have to be the same. Also, the first and second push cam portions 133-1 and 133-2 may have a phase difference and the first and second cam portions 5-1 and 5-2 may have a phase difference.

Also, although the first and second push cam portions 133-1 and 133-2 have the first and second cam profiles in FIGS. 9A through 9C and FIGS. 11A and 11B, the first and second cam portions 5-1 and 5-2 may have the first and second cam profiles.

Figure 12:
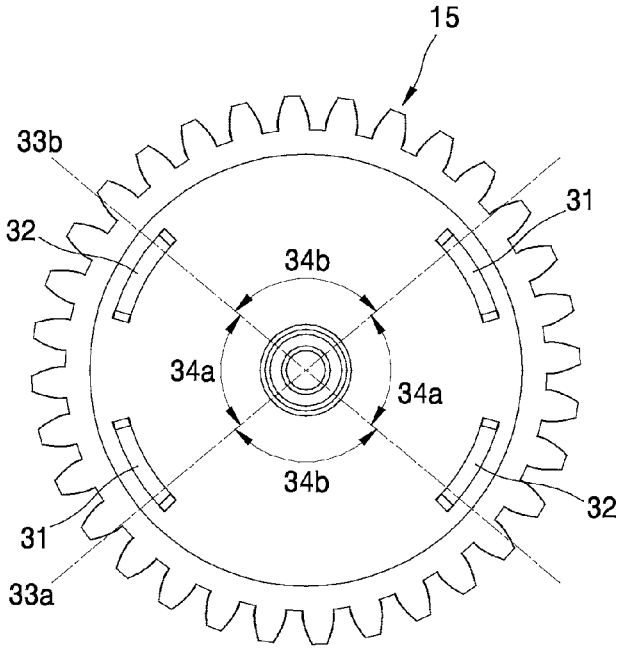
FIG. 12 is a plan view illustrating a phase gear according to an example embodiment.

Modes of the power transmitter 2 may be detected by a mode detector. FIG. 12 is a plan view illustrating the phase gear 15 according to an example embodiment. Referring to FIG. 12, the phase gear 15 includes a detection plate. The detection plate may include first and second detection plates 31 and 32 that are spaced apart from each other in a rotational direction of the phase gear 15. In the present example embodiment, two pairs of first and second detection plates 31 and 32 are provided. For example, in the cam profiles of FIGS. 9A and 9B or FIG. 11A, the first selective connection mode, the release mode (first release mode), the second selective connection mode, and the release mode (second release mode) may be detected between positions 33*a* and 33*b* in FIG. 12. For example, when the first detection plate 31 is detected by a sensor 30 (FIG. 3), a controller (not shown) may recognize that a mode is the first selective connection mode. When the second detection plate 32 is detected, the controller may recognize that a mode reaches the second release mode through the first release mode and the second selective connection mode. The controller turns on the clutch 6, rotates the phase gear 15, and receives a detection signal of the sensor 30. For example, a signal of the sensor 30 when the first and second detection plates 31 and 32 are detected is referred to as a high (H) signal, and a signal of the sensor 30 when the first and second detection plates 31 and 32 are not detected is referred to as a low (L) signal. Since an angle of a section 34*a* between the first detection plate 31 and the second detection plate 32 and an angle of a section 34*b* between the second detection plate 32 and the first detection plate 31 are different from each other, the controller may determine a position of the first detection plate 31, for example, the position 33*a* of FIG. 12, based on a duration time of an L signal of the detection signal of the sensor 30. The position becomes a reference position, and a mode of the power transmitter 2 becomes the first selective connection mode at the reference position. Alternatively, a position of the second detection plate 32, for example, the position 33*b*, may become a reference position, and in this case, a mode of the power transmitter 2 becomes the second release mode. After determining the reference position, the controller may turn on or off the clutch 6 according to needs and may change the power transmitter 2 to a desired mode.

For example, in the cam profiles of FIG. 9C or 11B, the second selective connection mode, the release mode, and the first selective connection mode may be detected between the positions 33*a* and 33*b* of FIG. 12. For example, when the first detection plate 31 is detected by the sensor 30, the controller (not shown) may recognize that a mode is the second selective connection mode, and when the second detection plate 32 is detected, the controller may recognize that a mode reaches the first selective connection mode through the release mode.

The controller may rotate the motor 1 at a low speed in the section 34*a* whose angle between the first detection plate 31 and the second detection plate 32 is small, and may rotate the motor 1 at a high speed in the section 34*b* whose angle between the second detection plate 32 and the first detection plate 31 is large. Accordingly, a mode may be rapidly changed and the operating efficiency of the power transmitter 2 may be improved.

According to the example embodiments of the driving device 1000, a driving force transmitted from the motor 1 to the first and second gears 3 and 4 may be controlled without changing a rotational direction of the motor 1. A rotational direction of the first output gear 7 may vary according to which one from among the first and second gears 3 and 4 is connected to the motor 1 without changing a rotational direction of the motor 1. The second output gear 8 connected to the motor 1 without being coupled to the power transmitter 2 may be further provided, and a rotational direction of the first output gear 7 may be changed without changing a rotational direction of the second output gear 8. Since the cam 5 is driven by the motor 1, an additional driving source for changing a mode of the power transmitter 2 may be omitted, thereby reducing material costs of the driving device 1000.

Figure 13:
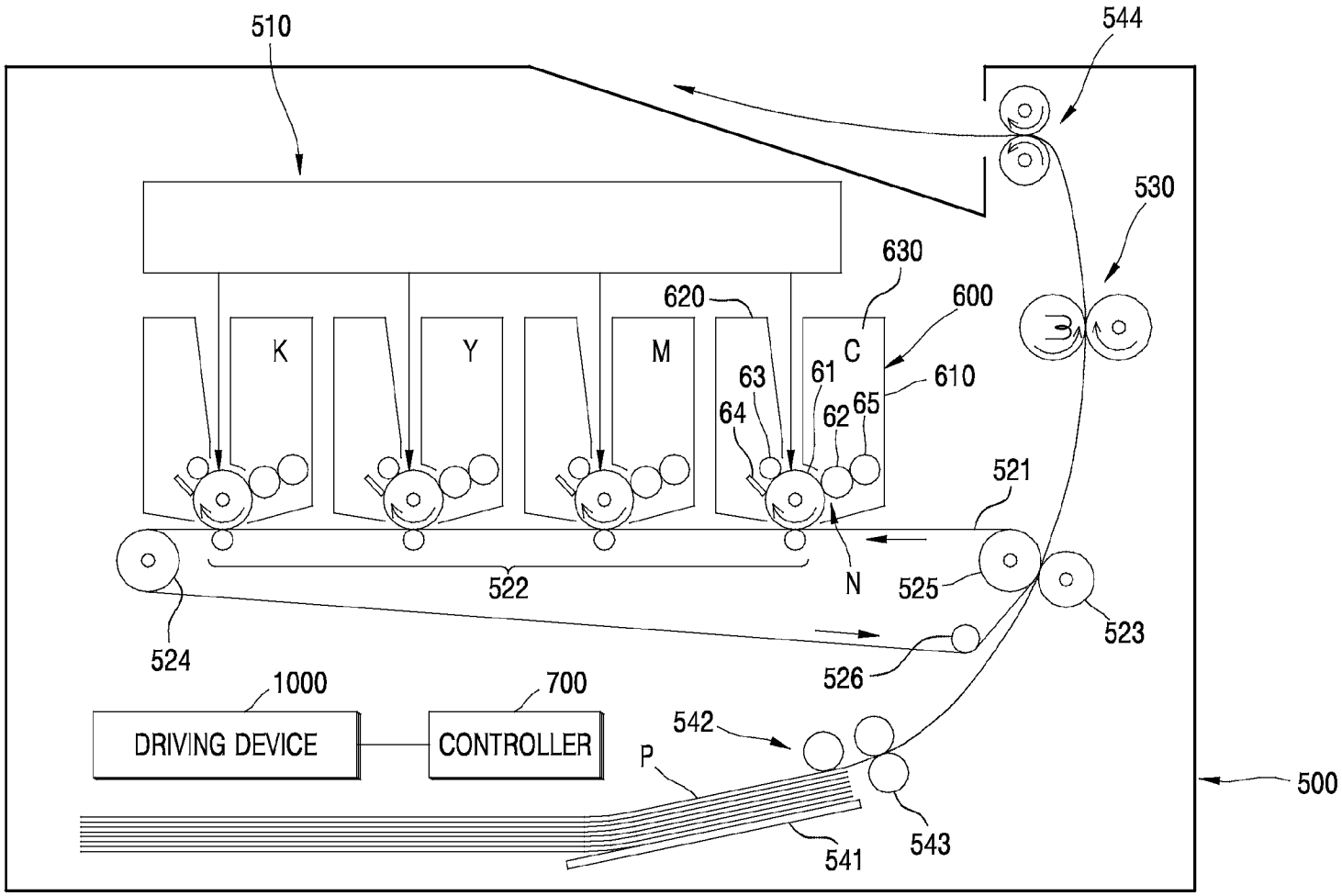
FIG. 13 is a view illustrating a configuration of an electrophotographic image forming apparatus according to an example embodiment.

FIG. 13 is a view illustrating a configuration of an electrophotographic image forming apparatus (referred to as 'image forming apparatus') according to an example embodiment. The image forming apparatus of the present example embodiment prints a color image to a recording medium P. Referring to FIG. 13, the image forming apparatus may include a main body 500 and a plurality of developer cartridges 600. The plurality of developer cartridges 600 are attached to/detached from the main body 500. An exposure unit 510, a transfer unit, and a fusing unit 530 are provided on the main body 500. Also, a recording medium feeding unit for loading thereon the recording medium P on which an image is to be formed and feeding the recording medium P is provided on the main body 500.

For color printing, the plurality of developer cartridges 600 may include four developer cartridges, for example, developer cartridges 600C, 600M, 600Y, and 600K for developing cyan (C), magenta (M), yellow (Y), and black (K) images. C, M, Y, and K toners may be respectively received in the developer cartridges 600C, 600M, 600Y, and 600K. Although not shown in FIG. 13, the C, M, Y, and K toners may be respectively received in four toner supply containers and may be respectively supplied from the four toner supply containers to the developer cartridges 600C, 600M, 600Y, and 600K. The developer cartridges 600 of the image forming apparatus may further include developer cartridges for receiving and developing other color toners such as light magenta toner and white toner. The following will be explained on the assumption that the image forming apparatus includes the developer cartridges 600C, 600M, 600Y, and 600K and reference numerals with letters C, M, Y, and K respectively denote elements for developing C, M, Y, and K images.

The developer cartridges 600 of the present example embodiment are integrated developer cartridges. The developer cartridges 600C, 600M, 600Y, and 600K may be attached to/detached from the main body 500 through a door (not shown). Each of the developer cartridges 600 may include a photosensitive unit 610 and a developing unit 620.

The photosensitive unit 610 includes a photosensitive drum 61. The photosensitive drum 61 that is a photosensitive body on a surface of which an electrostatic latent image is formed may include a conductive metal pipe and a photosensitive layer formed on an outer circumferential surface of the conductive metal pipe. A charging roller 63 is a charger for charging the photosensitive drum 61 to a uniform surface potential. A charging brush or a corona charger, instead of the charging roller 63, may be used. The photosensitive unit 610 may further include a cleaning roller (not shown) for removing a foreign material attached to a surface of the charging roller 63. A cleaning blade 64 is a cleaning unit that removes a foreign material and toner remaining on a surface of the photosensitive drum 61 after a transfer process that is described below. Another type of cleaning device such as a rotating brush, instead of the cleaning blade 64, may be used.

The developing unit 620 includes a toner receiving portion 630. The developing unit 620 supplies toner received in the toner receiving portion 630 to an electrostatic latent image formed on the photosensitive drum 61 and develops the electrostatic latent image into a visible toner image. Examples of a developing method include a one-component developing method using toner and a two-component developing method using toner and a carrier. The developer cartridge 600 of the present example embodiment uses a one-component developing method. A developing roller 62 is used to supply toner to the photosensitive drum 61. A developing bias voltage for supplying toner to the photosensitive drum 61 may be applied to the developing roller 62.

In the present example embodiment, a contact developing method in which the developing roller 62 and the photosensitive drum 61 contact each other to form a developing nip is used. A supply roller 65 supplies toner in the toner receiving portion 630 to a surface of the developing roller 62. To this end, a supply bias voltage may be applied to the supply roller 65. The developing unit 620 may further include a regulation member (not shown) that regulates the amount of toner supplied by the developing roller 62 to a developing nip N where the photosensitive drum 61 and the developing roller 62 contact each other. The regulation member may be, for example, a doctor blade that elastically contacts the surface of the developing roller 62.

The exposure unit 510 forms an electrostatic latent image on the photosensitive drum 61 by irradiating light modulated to correspond to image information to the photosensitive drum 61. A laser scanning unit (LSU) using a laser diode as a light source or a light-emitting diode (LED) exposure unit using an LED as a light source may be used as the exposure unit 510.

The transfer unit may include an intermediate transfer belt 521, a primary transfer roller 522, and a secondary transfer roller 523. Toner images developed on the photosensitive drums 61 of the developer cartridges 600C, 600M, 600Y, and 600K are temporarily transferred to the intermediate transfer belt 521. The intermediate transfer belt 521 circulates by being supported by support rollers 524, 525, and 526. Four primary transfer rollers 522 are located to face the photosensitive drums 61 of the developer cartridges 600C, 600M, 600Y, and 600K with the intermediate transfer belt 521 therebetween. A primary transfer bias voltage for transferring the toner images developed on the photosensitive drums 61 to the intermediate transfer belt 521 is applied to the four primary transfer rollers 522. A corona transfer unit or a transfer unit using a pin-scorotron method, instead of the primary transfer roller 522, may be used. The secondary transfer roller 523 faces the intermediate transfer belt 521. A secondary transfer bias voltage for transferring the toner images transferred to the intermediate transfer belt 521 to the recording medium P is applied to the secondary transfer roller 523.

When a print command is received from a host (not shown), a controller (not shown) charges a surface of the photosensitive drum 61 to a uniform potential by using the charging roller 63. The exposure unit 510 forms an electrostatic latent image on the photosensitive drums 61 by scanning four light beams to correspond to color image information to the photosensitive drums 61 of the developer cartridges 600C, 600M, 600Y, and 600K. The developing rollers 62 of the developer cartridges 600C, 600M, 600Y, and 600K develop the electrostatic latent images to visible toner images by supplying C, M, Y, and K toners to the photosensitive drums 61. The developed toner images are transferred to the intermediate transfer belt 521. The recording medium P stacked on a loader 541 is picked up one by one by a pickup roller 542, and is fed by a feed roller 543 to a transfer nip formed by the secondary transfer roller 523 and the intermediate transfer belt 521. The toner images transferred to the intermediate transfer belt 521 are transferred to the recording medium P due to a secondary transfer bias voltage applied to the secondary transfer roller 523. When the recording medium P passes through the fusing unit 530, the toner images are fixed to the recording medium P due to heat and pressure. When the toner images are completely fixed to the recording medium P, the recording medium P is discharged to the outside by a discharge roller 544.

Figure 14:
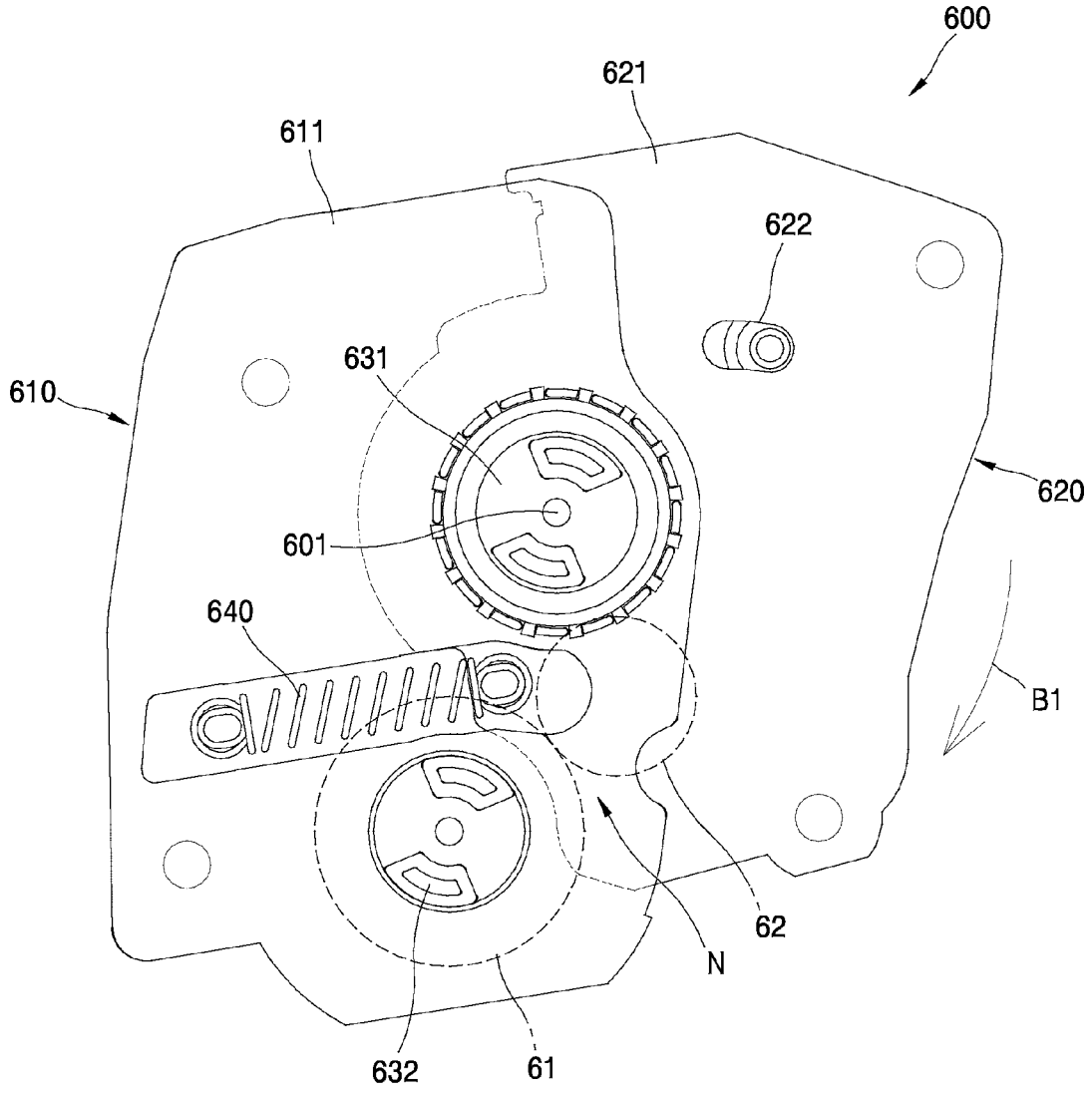
FIGS. 14 and 15 are side views illustrating a developer cartridge according to an example embodiment, respectively illustrating a state in which a developing nip is formed between a photosensitive drum and a developing roller in contact with each other and a state in which the photosensitive drum and the developing roller are separated from each other and the developing nip is removed.
Figure 15:
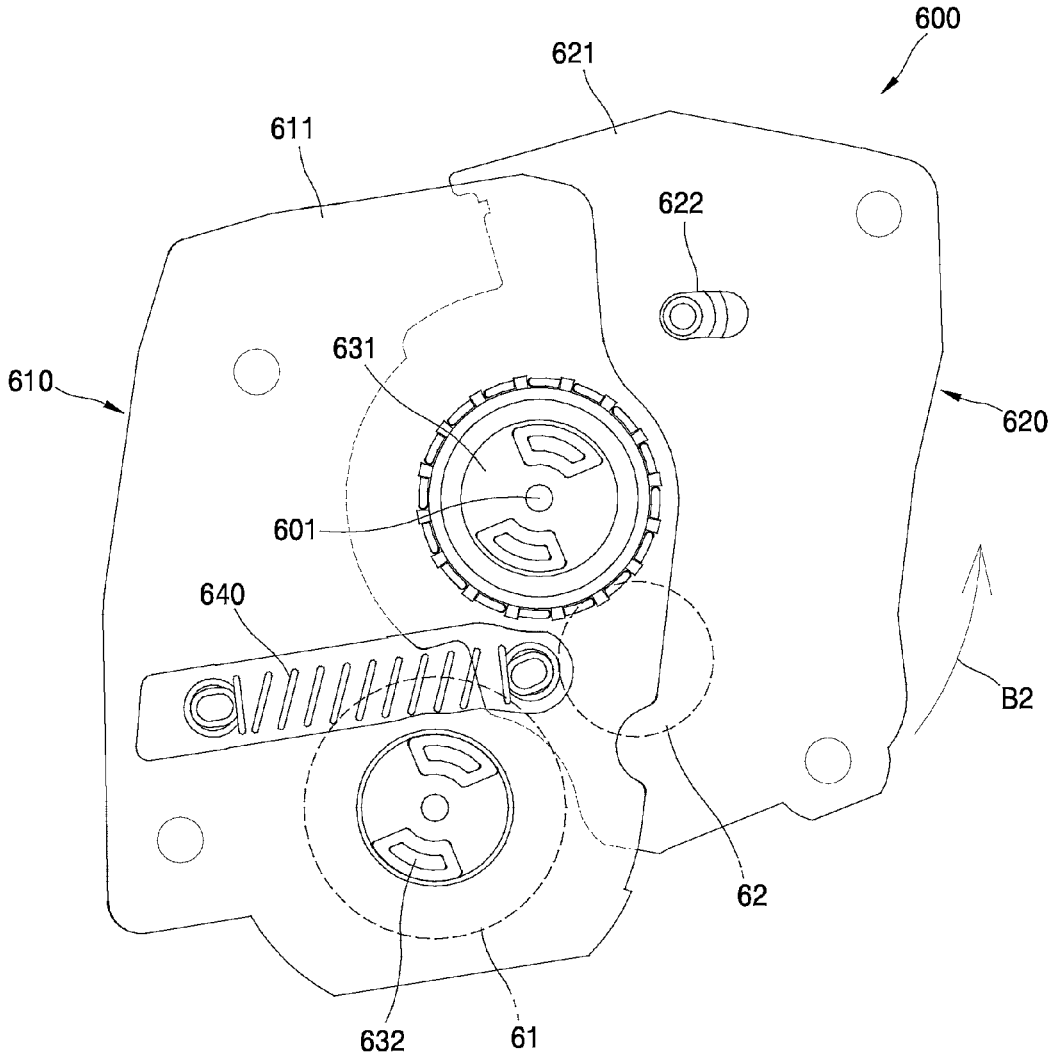

FIGS. 14 and 15 are side views illustrating the developer cartridge 600 according to an example embodiment. FIG. 14 illustrates a state in which the photosensitive drum 61 and the developing roller 62 contact each other to form the developing nip N. FIG. 15 illustrates a state in which the photosensitive drum 61 and the developing roller 62 are separated from each other to remove the developing nip N.

Referring to FIGS. 14 and 15, the photosensitive unit 610 includes a first frame 611, and the photosensitive drum 61 supported on the first frame 611. The developing unit 620 includes a second frame 621, and the developing roller 62 supported on the second frame 621. The photosensitive drum 610 and the developing unit 620 are connected to pivot to a developing position (see FIG. 14) at which the photosensitive drum 61 and the developing roller 62 contact each other to form the developing nip N and a non-developing position (see FIG. 15) at which the photosensitive drum 61 and the developing roller 62 are separated from each other to remove the developing nip N. For example, the photosensitive unit 610 and the developing unit 620 are connected to pivot to the developing position and the non-developing position about a hinge shaft 601. Since the photosensitive drum 61 in the image forming apparatus relates to a position of the primary transfer roller 522 or the like, a position of the photosensitive drum 61 is fixed when the developer cartridge 600 is mounted on the main body 500. The developing unit 620 is coupled to the photosensitive unit 610 to pivot about the hinge shaft 601.

Rotatable members of the developer cartridge 600, for example, the photosensitive drum 61, the developing roller 62, and the supply roller 65, may be driven by being connected to the driving device 1000 provided on the main body 500 when the developer cartridge 600 is mounted on the main body 500. For example, a first coupler 631 connected to the driving device 1000 provided on the main body 500 when the developer cartridge 600 is mounted on the main body 500 may be provided on the developer cartridge 600. The rotatable members may be connected to the first coupler 631 by using a power connecting portion (not shown) such as gears. A second coupler 632 connected to the driving device 1000 provided on the main body 500 when the developer cartridge 600 is mounted on the main body 500 may be further provided on the developer cartridge 600. In this case, rotatable members of the developing unit 620, for example, the developing roller 62 and the supply roller 65, may be driven by being connected to the first coupler 631, and rotatable members provided on the photosensitive unit 610, for example, the photosensitive drum 61, may be driven by being connected to the second coupler 632. The second coupler 632 may be located on the same axis as, for example, a rotational axis of the photosensitive drum 61, and may be provided on the rotational axis of the photosensitive drum 61. The hinge shaft 601 may be on the same axis as, for example, a rotational axis of the first coupler 631.

An elastic member 640 applies an elastic force in a direction in which the developing nip N is formed. The elastic member 640 applies an elastic force to the developing unit 620 so that the developing unit 620 pivots in a direction in which the developing nip N is formed. The developing unit 620 may pivot about the hinge shaft 601 due to an elastic force of the elastic member 640 so that the developing roller 62 contacts the photosensitive drum 61 and thus the developing nip N is formed as shown in FIG. 14.

The driving device 1000 may have a structure of FIGS. 1 through 12. The driving device 1000 is provided on the main body 500 and applies a driving force for driving elements of the main body 500 and the developer cartridge 600.

Figure 16:
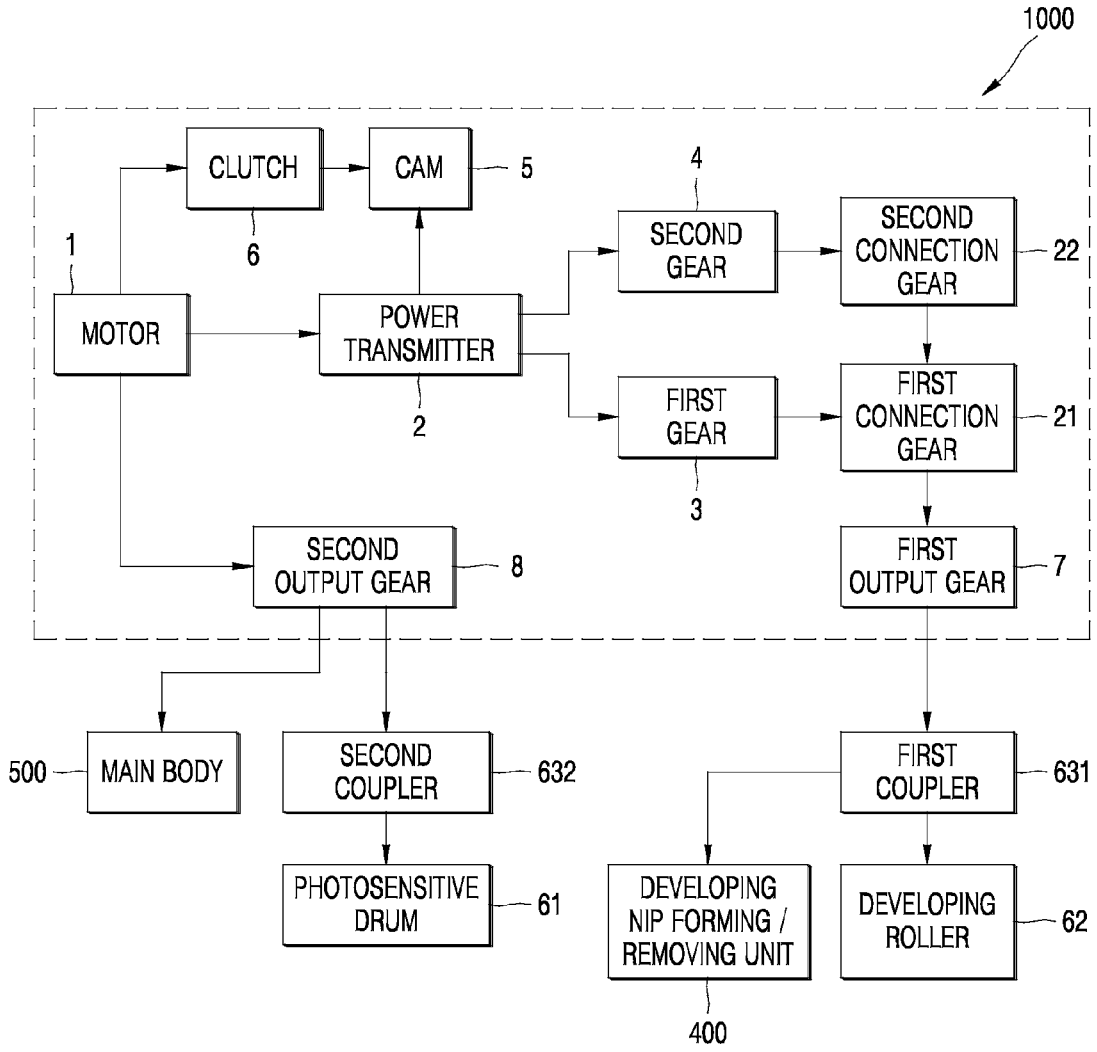
FIG. 16 is a block diagram for explaining power connection of the image forming apparatus according to an example embodiment.

FIG. 16 is a block diagram for explaining power connection of the image forming apparatus according to an example embodiment. Referring to FIG. 16, the first output gear 7 may be connected to the first coupler 631 and may drive the developing roller 62. The second output gear 8 (e.g., the gear 13 of FIG. 2) may be connected to the second coupler 632 and may drive the photosensitive drum 61. The second output gear 8 may be connected to other driving elements of the main body 500, for example, the pickup roller 542, the feed roller 543, the discharge roller 544, the support rollers 524, 525, and 526 for driving the intermediate transfer belt 521, and the fusing unit 530. The first and second cam portions 5-1 and 5-2 and the first and second push cam portions 133-1 and 133-2 have the cam profiles of FIGS. 9A and 9B or FIG. 11A.

During an image forming operation, the photosensitive drum 61 and the developing roller 62 contact each other to form the developing nip N. When a state in which the photosensitive drum 61 and the developing roller 62 contact each other is maintained while an image forming operation is not performed, the developing roller 62 may be deformed or the photosensitive drum 61 may be damaged. Also, assuming that a plurality of images are continuously printed, when a state in which the photosensitive drum 61 and the developing roller 62 contact each other is maintained during a non-image forming period between image forming periods, toner consumption may be increased and waste toner may be increased since toner on the developing roller 62 is moved to the photosensitive drum 61, and stress may be applied to the developing roller 62 and the lifetime of the developing roller 62 may be reduced since the photosensitive drum 61 and the developing roller 62 contact each other and rotate.

In order to solve these problems, the developer cartridge 600 of the present example embodiment includes a developing nip forming/removing unit 400 for changing the developing unit 620 to a developing position at which the developing nip N is formed and a non-developing position at which the developing nip N is removed. For example, the developing nip forming/removing unit 400 may be connected to the first coupler 631, and may allow the developing unit 620 to be changed from the developing position to the non-developing position when a mode of the power transmitter 2 is a second selective connection mode and the developing unit 620 to be changed from the non-developing position to the developing position when a mode of the power transmitter 2 is a first selective connection mode. During printing (e.g., during an image forming operation or an image forming period), the developing unit 620 is located at the developing position, and during non-printing (e.g., while an image forming operation is not performed or during a non-image forming period), the developing unit 620 is located at the non-developing position. Referring to FIG. 16, the developing nip forming/removing unit 400 is connected to the first coupler 631 and is driven by the first output gear 7.

Figure 17:
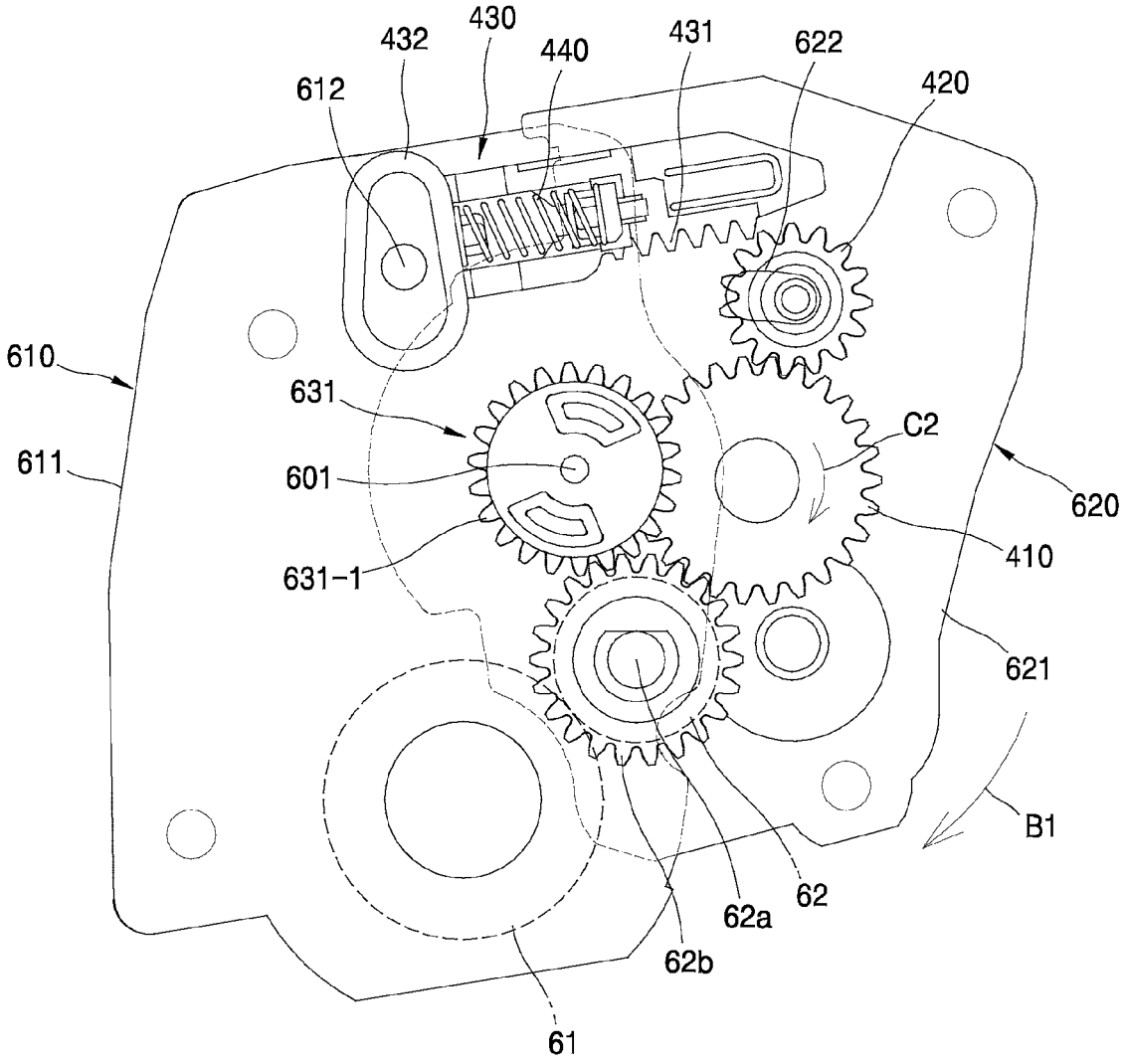
FIG. 17 is a side view illustrating the developer cartridge according to an example embodiment.
Figure 18:
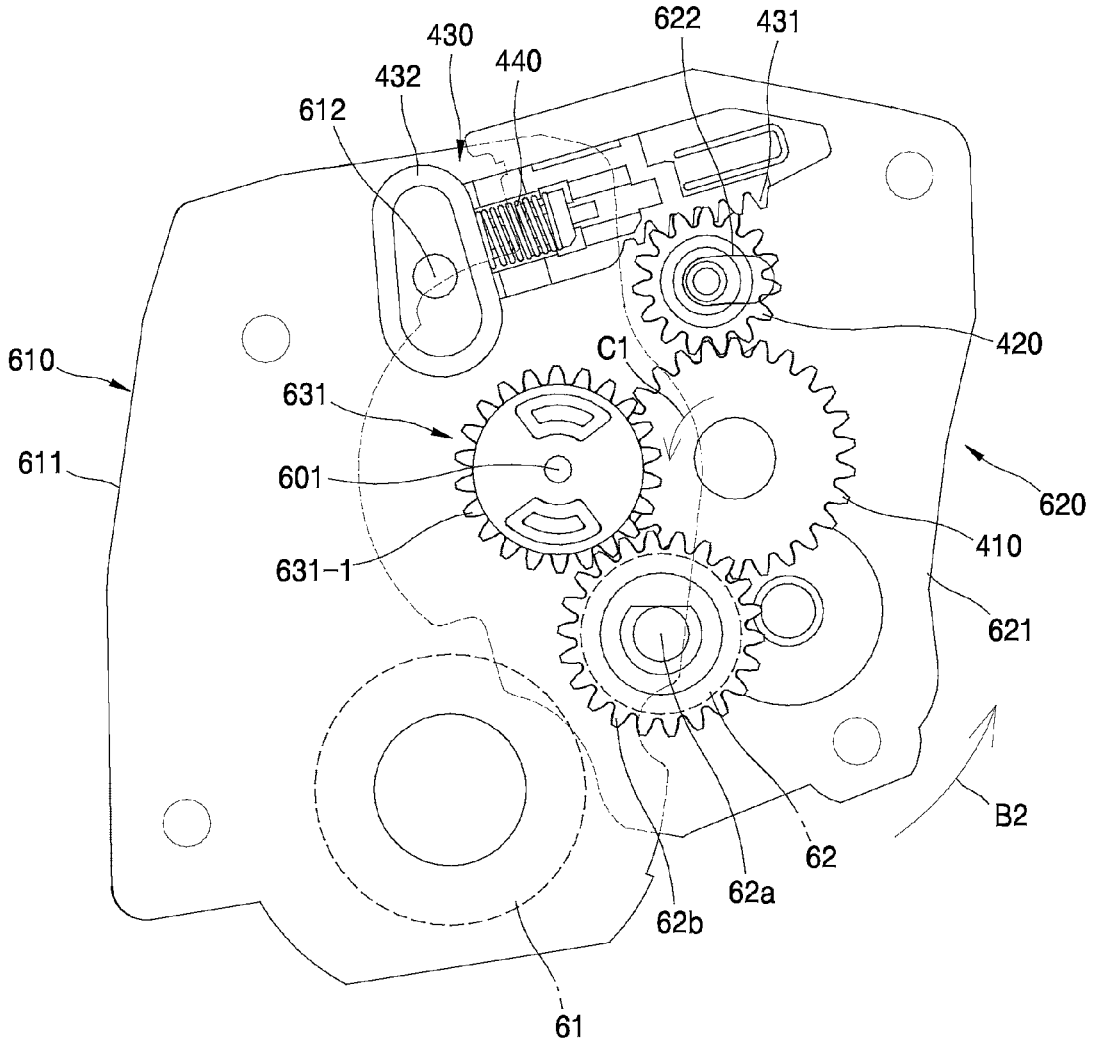
FIG. 18 is a side view illustrating the developer cartridge of FIG. 17, illustrating a state in which a developing unit is located at a release position.

FIG. 17 is a side view illustrating the developer cartridge 600 according to an example embodiment. FIG. 18 is a side view illustrating a state in which the developing unit 620 is located at a non-developing position in the developer cartridge 600 of FIG. 17. Referring to FIGS. 17 and 18, the developing nip forming/removing unit 400 may include a driving gear 410, a movable member 430, and a swing gear 420. The driving gear 410 may rotate by being connected to, for example, the first coupler 631. In the present example embodiment, the first coupler 631 includes a gear portion 631-1, and the gear portion 631-1 is engaged with a developing roller gear **62*b* coupled to a shaft 62*a* of the developing roller 62. The driving gear 410 is engaged with the developing roller gear 62*b***.

The movable member 430 is provided on the developing unit 620. The movable member 430 changes the developing unit 620 to a developing position and a non-developing position by pivoting the developing unit 620 about the hinge shaft 601. To this end, the movable member 430 is provided on the developing unit 620, for example, the second frame 621 to move to first and second positions respectively corresponding to the non-developing position and the developing position. The movable member 430 includes a gear portion 431. The movable member 430 of the present example embodiment slides to the first and second positions, and the gear portion 431 is a rack gear. The movable member 430 moves to the first and second positions in a rotational direction of the driving gear 410. For example, the driving gear 410 rotates in a first direction C1 during non-printing, and rotates in a second direction C2 during printing. The first direction C1 is a rotational direction of the driving gear 410 during non-printing and the second direction C2 is a rotational direction of the driving gear 410 during printing.

The movable member 430 includes a second connecting portion 432 connected to a first connecting portion 612 provided on the photosensitive unit 610, for example, the first frame 611. For example, the first connecting portion 612 may have a protruding shape, and the second connecting portion 432 may have an annular shape into which the first connecting portion 612 is inserted. Shapes of the first and second connecting portions 612 and 432 are not limited to those of FIG. 17.

The swing gear 420 is located between the movable member 430 and the driving gear 410. The swing gear 420 rotates by being connected to the driving gear 410. The swing gear 420 is engaged with the driving gear 410, and according to a rotational direction of the driving gear 410, is connected to the gear portion 431 and is changed to a third position which the movable member 430 is allowed to move from the second position to the first position and is separated from the gear portion 431 and is changed to a fourth position at which the movable member 430 is allowed to move from the first position to the second position. When the driving gear 410 rotates in the first direction C1, the swing gear 420 is located at the third position and is engaged with the gear portion 431 as shown in FIG. 18. When the driving gear 410 rotates in the second direction C2, the swing gear 420 is located at the fourth position and is separated from the gear portion 431 as shown in FIG. 17. A guide portion 622 may be provided on the developing unit 620, for example, on the second frame 621, so that the swing gear 420 may swing to the third and fourth positions. The guide portion 622 may be, for example, a long hole.

A process of forming/removing the developing nip N will now be explained with reference to FIGS. 1 through 12 and FIGS. 17 and 18.

In FIG. 17, the developing unit 620 is located at the developing position, the movable member 430 is located at the second position, and the swing gear 420 is located at the fourth position.

A controller 700 rotates the motor 1 in order to perform printing. The motor 1 rotates the shaft 100. The second coupler 632 is connected to the second output gear 8 directly or with a power transmitting member therebetween and rotates in a print direction. The controller 700 turns on the clutch 6. The cam 5 is rotated by the motor 1. The sensor 30 detects the first and second detection plates 31 and 32. The controller 700 receives a detection signal of the sensor 30. The controller 700 determines a position of the first detection plate 31, that is, the position 33*a* in FIG. 12, based on a duration time of an L signal of the detection signal of the sensor 30. The position becomes a reference position, and a mode of the power transmitter 2 becomes the first selective connection mode at the reference position. After determining the reference position, the controller 700 turns off the clutch 6. In the first selective connection mode, as shown in FIG. 7A, the first fixed latch portion 112-1 and the first movable latch portion 121-1 are engaged with each other, and the second fixed latch portion 112-2 and the second movable latch portion 121-2 are separated from each other. Accordingly, the first gear 3 rotates. The first output gear 7 rotates forwardly due to the first gear 3. The first coupler 631 is connected to the first output gear 7 directly or with a power transmitting member therebetween, and the developing roller 62 rotates in the print direction due to the first output gear 7.

The driving gear 410 is connected to the first coupler 631 and rotates in the second direction C2. Accordingly, the swing gear 420 is located at the fourth position as shown in FIG. 17, and a state in which the swing gear 420 is separated from the gear portion 431 is maintained. Accordingly, the movable member 430 is maintained at the second position, and the developing unit 620 is maintained at the developing position. A printing operation may be performed in a state where the developing nip N is formed.

During non-printing, the developing unit 620 is changed to the non-developing position. To this end, the controller 700 turns on the clutch 6. The cam 5 rotates, and the power transmitter 2 reaches the second selective connection mode through the first release mode.

In the second selective connection mode, as shown in FIG. 7C, the first fixed latch portion 112-1 and the first movable latch portion 121-1 are separated from each other and the second fixed latch portion 112-2 and the second movable latch portion 121-2 are engaged with each other. Accordingly, the second gear 4 rotates. The first output gear 7 rotates backwardly due to the second gear 4. Since the first release mode is located between the first selective connection mode and the second selective connection mode, the first output gear 7 may not be locked and a rotational direction may be naturally changed from a forward direction to a backward direction. The developing roller 62 rotates in a non-print direction opposite to the print direction due to the first output gear 7. Since a rotational direction of the motor 1 does not change, the photosensitive drum 61 rotates in the print direction.

A rotational force of the first output gear 7 is transmitted through the first coupler 631 to the driving gear 410, and the driving gear 410 rotates in the first direction C1 . Accordingly, the swing gear 420 swings to the third position as shown in FIG. 18, and is engaged with the gear portion 431. When the driving gear 410 continuously rotates in the first direction C1, the swing gear 420 that is engaged with the gear portion 431 rotates. The movable member 430 slides from the fourth position to the third position, and the second connecting portion 432 pulls the first connecting portion 612. Since a position of the photosensitive unit 610 is fixed, the developing unit 620 pivots about the hinge shaft 601 in a direction B2. As shown in FIG. 17, when the movable member 430 reaches the third position, the developing unit 620 reaches the non-developing position and the developing roller 62 is separated from the photosensitive drum 61 to remove the developing nip N.

When the developing nip N is completely removed, the controller 700 recognizes that the detection signal of the sensor 30 becomes an H signal again and then the power transmitter 2 reaches the second release mode, and turns off the clutch 6.

In an example embodiment, a reduction gear ratio of gears between the motor 1 and the cam 5 and a reduction gear ratio of gears between the motor 1 and the swing gear 420 may be determined so that the developing nip N is completely removed during a rotation time of the motor 1 taken from when a mode reaches the second selective connection mode to when the mode reaches the second release mode. Accordingly, the clutch 6 does not have to be turned off in the second selective connection mode. That is, when the developing nip N needs to be removed, the controller 700 turns on the clutch 6 at the reference position (e.g., the position 33*a* of FIG. 12) and then turns off the clutch 6 when the position 33*b* of FIG. 12 is detected. Accordingly, the developing nip N is removed and the power transmitter 2 reaches the second release mode.

When printing is to be performed again, the controller 700 rotates the motor 1 and turns on the clutch 6. When the cam 5 rotates and the first detection plate 31 is detected by the sensor 30 again, the controller 700 recognizes that the power transmitter 2 is in the first selective connection mode and turns off the clutch 6.

In the first selective connection mode, the first gear 3 rotates and the first output gear 7 rotates forwardly. The driving gear 410 is connected to the first output gear 7 through the first coupler 631 and rotates in the second direction C2. Accordingly, the swing gear 420 swings to the fourth position as shown in FIG. 17, and the developing unit 620 pivots in a direction B1 due to an elastic force of the elastic member 640. Since the first and second connecting portions 612 and 432 are connected to each other, the movable member 430 slides to the second position. When the movable member 430 reaches the second position, the swing gear 420 is separated from the gear portion 431. When a return spring 440 for elastically biasing the movable member 410 to the second position is provided, the movable member 410 may more easily return to the second position. The movable member 430 may be maintained at the second position, and a printing operation may be performed in a state where the developing nip N is formed.

When only the photosensitive drum 61 needs to rotate and the developing roller 62 does not need to rotate, the power transmitter 2 may be changed to the release mode (the second release mode in the cam profiles of FIGS. 9A, 9B, and 11A). For example, the power transmitter 2 may be changed to the release mode when a surface of the photosensitive drum 61 is cleaned and a surface potential of the photosensitive drum 61 is initialized before printing starts, when a recording medium jam is removed, or when a surface of the photosensitive drum 61 is cleaned after printing is completed.

Before printing starts, the developing unit 620 is located at the non-developing position at which the developing nip N is removed. The power transmitter 2 is in the second release mode, and the first and second fixed latch portions 121-1 and 121-2 are separated from the first and second movable latch portions 112-1 and 112-2. Accordingly, a rotational force of the motor 1 is not transmitted to the first and second gears 3 and 4, and the first output gear 7 does not rotate. In this state, even when the motor 1 rotates, the developing roller 62 does not rotate and only driving members of the main body 500 and the photosensitive drum 61 rotate.

Right after printing is completed and when a recording medium jam occurs, the developing unit 620 is located at the developing position at which the developing nip N is formed. The power transmitter 2 is in the first selective connection mode. The controller 700 turns on the clutch 6 and rotates the cam 5. The power transmitter 2 enters the second release mode through the first release mode and the second selective connection mode. In this process, the first output gear 7 rotates backwardly, the developing nip forming/removing unit 400 is driven, the developing unit 620 is located at the non-developing position, and the developing nip N is removed. The controller 700 turns off the clutch 6. In this state, the motor 1 may be stopped in order to remove the recording medium jam, and the photosensitive drum 61 may be cleaned by rotating the motor 1.

As described above, a rotational direction of the motor 1 does not change in a process of forming/removing the developing nip N. Accordingly, since a change in an inertial load of driven bodies driven by the motor 1 is small, a structure of a driving circuit for driving the motor 1 may be simplified. Also, since driving directions of the driven bodies driven by the motor 1, except elements of the developing unit 620, are maintained constant, the durability of the driven bodies may be improved.

According to the driving device and the image forming apparatus including the same of the one or more example embodiments, a driving force of a motor may be selectively transmitted to two driven bodies without changing a rotational direction of the motor.

According to the driving device and the image forming apparatus including the same of the one or more example embodiments, one driven body may rotate forwardly/backwardly without changing a rotational direction of a motor and a driving force transmitted to the driven body may be controlled.

While one or more example embodiments have been described with reference to the figures, it will be understood by those of ordinary skill in the art that various changes in form and details may be made therein without departing from the spirit and scope of the disclosure as defined by the following claims.

What is claimed is:

1. An apparatus comprising:

a motor configured to provide a rotational force;

a first gear;

a second gear;

a power transmitter configured to selectively transfer the rotational force from the motor to the first gear and from the motor to the second gear;

a cam configured to set a mode of the power transmitter to one of:

a release mode in which the rotational force from the motor is disconnected from the first gear and the second gear, a first connection mode in which the first gear is connected to the rotational force from the motor and the second gear is disconnected from the rotational force from the motor, and a second connection mode in which the second gear is connected to the rotational force from the motor and the first gear is disconnected from the rotational force from the motor; and a clutch configured to selectively transfer the rotational force from the motor to the cam.

2. The apparatus of claim 1, wherein the power transmitter comprises a rotatable shaft configured to receive the rotational force from the motor, and the first gear, the second gear, and the cam are rotatably provided on the rotatable shaft.

3. The apparatus of claim 2, wherein the power transmitter further comprises:

a first fixed latch member fixed to the shaft and including a first fixed latch portion;

a second fixed latch member fixed to the shaft and including a second fixed latch portion;

a first movable latch member rotatably provided on the shaft, configured to move in an axial direction of the shaft, connected in the axial direction to the first gear, and including a first movable latch portion configured to engage with the first fixed latch portion of the first fixed latch member;

a second movable latch member rotatably provided on the shaft, configured to move in an axial direction of the shaft, connected in the axial direction to the second gear, and including a second movable latch portion configured to engage with the second fixed latch portion of the second fixed latch member;

a first elastic member configured to apply an elastic force to the first movable latch member to move the first movable latch member to engage the first fixed latch portion; and a second elastic member configured to apply an elastic force to the second movable latch member to move the second movable latch member to engage the second fixed latch portion, wherein the cam is configured to move the first movable latch member in the axial direction based on a rotational position of the cam to selectively engage the first movable latch portion with the first fixed latch portion, and the cam is configured to move the second movable latch member in the axial direction according to the rotational position of the cam to selectively engage the second movable latch portion with the second fixed latch portion.

4. The apparatus of claim 3, wherein the first elastic member is located between the first gear and the first movable latch member, and the second elastic member is located between the second gear and the second movable latch member.

5. The apparatus of claim 3, wherein the power transmitter further comprises:

a first push member provided on the shaft between the cam and the first movable latch member, and moveable in the axial direction, the first push member configured to contact the first movable latch member based on the elastic force applied by the first elastic member, and a second push member provided on the shaft between the cam and the second movable latch member, and moveable in the axial direction, the second push member configured to contact the second movable latch member based on the elastic force applied by the second elastic member, wherein the cam moves the first push member in the axial direction according to the rotational position of the cam to selectively engage the first movable latch portion with the first fixed latch portion, and wherein the cam moves the second push member in the axial direction according to the rotational position of the cam to selectively engage the second movable latch portion with the second fixed latch portion.

6. The apparatus of claim 5, wherein the first push member comprises a first push cam portion, the second push member comprises a second push cam portion, the cam comprises a first cam portion and a second cam portion, the first cam portion is configured to contact the first push cam portion, the second cam portion is configured to contact the second push cam portion;

at least one of the first push cam portion and the first cam portion has a first cam profile, and at least one of the second push cam portion and the second cam portion has a second cam profile.

7. The apparatus of claim 6, wherein the first cam profile comprises a first connection section in which the first fixed latch portion is engaged with the first movable latch portion, and a first separation section in which the first fixed latch portion is separated from the first movable latch portion, the second cam profile comprises a second connection section in which the second fixed latch portion is engaged with the second movable latch portion, and a second separation section in which the second fixed latch portion is separated from the second movable latch portion, and the first connection mode and the second connection mode are set based on a phase difference between the first and second cam portions, shapes of the first and second cam profiles, and a phase difference between the first and second cam profiles.

8. The apparatus of claim 7, wherein the release mode is between the first and second selective connection modes.

9. The apparatus of claim 7, wherein the release mode comprises first and second release modes, wherein the first release mode is between the first and second selective connection modes and the second release mode is between the second and first selective connection modes.

10. The apparatus of claim 1, further comprising a first output gear connected to the first gear by an even number of gears and connected to the second gear by an odd number of gears.

11. The apparatus of claim 10, further comprising a second output gear connected to the motor and disconnected from the power transmitter.

12. The apparatus of claim 10, further comprising:

a first connection gear configured to connect the first gear and the first output gear; and a second connection gear configured to connect the second gear and the first connection gear.

13. The apparatus of claim 1, further comprising a mode detector configured to detect the mode of the power transmitter.

14. The apparatus of claim 13, wherein the mode detector comprises:

a phase gear connected to and rotatable by the cam, the phase gear comprising one or more detection plates; and a sensor configured to detect the one or more detection plates.

15. The apparatus of claim 14, wherein the one or more detection plates comprise:

a first detection plate, and a second detection plate spaced apart from the first detection plate in a rotational direction of the phase gear.

16. An electrophotographic image forming apparatus comprising:

a main body comprising:

a photosensitive body on which an electrostatic latent image is formed, and a developing roller configured to supply toner to the electrostatic latent image; and a driver configured to drive the developing roller and the photosensitive body, the driver comprising:

a motor configured to provide a rotational force;

a first gear connected to one of the developing roller and the photosensitive body;

a second gear connected to the other one of the developing roller and the photosensitive body;

a power transmitter configured to selectively transfer the rotational force from the motor to the first gear and from the motor to the second gear;

a cam configured to set the power transmitter to one of:

a release mode in which the rotational force from the motor is disconnected from the first gear and the second gear, a first connection mode in which the first gear is connected to the rotational force from the motor and the second gear is disconnected from the rotational force from the motor, and a second connection mode in which the second gear is connected to the rotational force from the motor and the first gear is disconnected from the rotational force from the motor; and a clutch configured to selectively transfer the rotational force from the motor to the cam.

17. An electrophotographic image forming apparatus comprising:

a main body;

a developer cartridge attachable to the main body and comprising:

a photosensitive drum, a developing roller configured to supply toner to an electrostatic latent image formed on the photosensitive drum, a first coupler connected to the developing roller, and a second coupler connected to the photosensitive drum;

a driver comprising:

a motor configured to provide a rotational force;

a first gear connected to one of the first coupler and the second coupler;

a second gear connected to the other one of the first coupler and the second coupler;

a power transmitter configured to selectively transfer the rotational force from the motor to the first gear and from the motor to the second gear;

a cam configured to set the power transmitter to one of:

a release mode in which the rotational force from the motor is disconnected from the first gear and the second gear, a first connection mode in which the first gear is connected to the rotational force from the motor and the second gear is disconnected from the rotational force from the motor, and a second connection mode in which the second gear is connected to the rotational force from the motor and the first gear is disconnected from the rotational force from the motor; and a clutch configured to selectively transfer the rotational force from the motor to the cam;

a first output gear connected to the first gear by an even number of gears, connected to the second gear by an odd number of gears, and connected to the first coupler; and a second output gear connected to the second coupler, connected to the motor, and disconnected from the power transmitter.

18. The electrophotographic image forming apparatus of claim 17, wherein the developer cartridge comprises:

a photosensitive unit comprising the photosensitive drum;

a developing unit comprising the developing roller, coupled to the photosensitive unit, and rotatable to a non-developing position in which the developing roller is separated from the photosensitive drum and a developing position in which the developing roller contacts the photosensitive drum and a developing nip is formed between the developing roller and the photosensitive drum; and a developing nip forming/removing unit connected to the first coupler and configured to form the developing nip in the first selective connection mode and remove the developing nip in the second selective connection mode, wherein the developing unit changes from the developing position to the non-developing position in the first selective connection mode and changes from the non-developing position to the developing position in the second selective connection mode.

19. The electrophotographic image forming apparatus of claim 18, further comprising:

a first connection gear configured to connect the first gear and the first output gear; and a second connection gear configured to connect the second gear and the first connection gear.

* * * * *